US009382670B2

(12) United States Patent
Herzog et al.

(10) Patent No.: US 9,382,670 B2
(45) Date of Patent: Jul. 5, 2016

(54) RAIL GUIDE APPARATUS FOR A RAIL LOADING AND UNLOADING MACHINE

(71) Applicant: Herzog Railroad Services, Inc., St. Joseph, MO (US)

(72) Inventors: Stanley M. Herzog, St. Joseph, MO (US); Ivan E. Bounds, St. Joseph, MO (US)

(73) Assignee: HERZOG RAILROAD SERVICES, INC., St. Joseph, MO (US)

( * ) Notice: Subject to any disclaimer, the term of this patent is extended or adjusted under 35 U.S.C. 154(b) by 237 days.

(21) Appl. No.: 14/171,482

(22) Filed: Feb. 3, 2014

(65) Prior Publication Data

US 2014/0216296 A1 Aug. 7, 2014

Related U.S. Application Data

(60) Provisional application No. 61/761,494, filed on Feb. 6, 2013.

(51) Int. Cl.

| | |
|---|---|
| ***E01B 29/17*** | (2006.01) |
| ***E01B 31/06*** | (2006.01) |
| ***B61D 47/00*** | (2006.01) |
| ***B61D 15/02*** | (2006.01) |

(52) U.S. Cl.

CPC ..... *E01B 29/17* (2013.01); *B61D 15/02* (2013.01); *B61D 47/00* (2013.01); *E01B 31/06* (2013.01); *Y10T 29/49826* (2015.01); *Y10T 408/36* (2015.01)

(58) Field of Classification Search

CPC ..... E01B 29/17; E01B 29/16; E01B 29/05; E01B 29/22; E01B 31/02; B60P 1/52; B60P 3/1066; B62B 2203/74

USPC ..... 104/2; 414/529, 531, 746.7

See application file for complete search history.

(56) References Cited

U.S. PATENT DOCUMENTS

| | | | | |
|---|---|---|---|---|
| 4,510,981 | A * | 4/1985 | Biller | B27L 1/08 144/246.2 |
| 4,794,861 | A | 1/1989 | Theurer et al. | |
| 4,884,509 | A | 12/1989 | Theurer et al. | |
| 4,911,599 | A | 3/1990 | Theurer et al. | |
| 5,193,461 | A | 3/1993 | Theurer et al. | |
| 5,243,918 | A | 9/1993 | Bounds | |
| 5,361,704 | A | 11/1994 | Bounds | |
| 5,469,791 | A | 11/1995 | Theurer et al. | |
| 5,511,484 | A | 4/1996 | Theurer et al. | |
| 5,590,601 | A | 1/1997 | Theurer et al. | |

(Continued)

FOREIGN PATENT DOCUMENTS

| | | | |
|---|---|---|---|
| GB | 2081781 | A | 2/1982 |
| GB | 2159558 | A | 12/1985 |

*Primary Examiner* — Mark Le

(74) *Attorney, Agent, or Firm* — Erickson Kernell IP, LLC

(57) ABSTRACT

A guide box for a rail loading and unloading machine. The guide box guides a rail from a ground location toward a drive unit and can be provided with actuators to enable steering of the rail. The guide box includes a base roller that underlies a rail path through the guide box. An arm extends upwardly along each side of the rail path and carries a guide roller. The arms are pivotable toward one another to abut the guide rollers over the rail path and thereby capture the rail between the guide rollers and the base roller or away from one another to enable insertion of a rail therebetween. The guide rollers are vertically pivotable to enable obstructions on the rail to pass through the guide box.

20 Claims, 28 Drawing Sheets

(56) References Cited

U.S. PATENT DOCUMENTS

| | | | | |
|---|---|---|---|---|
| 5,630,365 | A | 5/1997 | Hertelendi | |
| 5,762,464 | A | 6/1998 | Hertelendi | |
| 5,904,098 | A | 5/1999 | Theurer et al. | |
| 6,283,353 | B1 * | 9/2001 | Gilbert | B27B 25/02 144/250.14 |
| 6,981,452 | B2 | 1/2006 | Herzog et al. | |
| 7,350,467 | B2 | 4/2008 | Green et al. | |
| 7,437,997 | B2 | 10/2008 | Herzog et al. | |
| 7,478,596 | B2 | 1/2009 | Theurer | |
| 7,707,943 | B2 | 5/2010 | Herzog et al. | |
| 7,765,935 | B2 | 8/2010 | Bounds | |
| 8,181,577 | B2 | 5/2012 | Bounds | |
| 2003/0205162 | A1 | 11/2003 | Herzog et al. | |
| 2008/0163781 | A1 | 7/2008 | Green et al. | |
| 2011/0041721 | A1 * | 2/2011 | Bounds | E01B 29/17 104/2 |

* cited by examiner

RAIL GUIDE APPARATUS FOR A RAIL LOADING AND UNLOADING MACHINE

CROSS-REFERENCE TO RELATED APPLICATIONS

This application claims priority to U.S. Provisional Patent Application No. 61/761,494 filed Feb. 6, 2013, the disclosure of which is hereby incorporated herein, in its entirety, by reference.

BACKGROUND

Modern railroad tracks are constructed using long sections of ribbon rail. The sections are often found in lengths up to about 1600 feet but can range up to 2000 feet or longer. Shorter sections of lengths as little as 300-320 feet are also available. These sections of ribbon rail are formed by butt-welding multiple sticks of rail, which traditionally come from a steel mill in thirty-nine foot or seventy-eight foot lengths. The welding of the ribbon rails is done at a welding plant and the welded ribbon rails are transported to their installation site on a specially constructed rail train. When existing track is being replaced, ribbon rails may be unloaded from the rail train using a rail unloading machine, such as the Rail unloading machines disclosed in U.S. Pat. Nos. 6,981,452 and 7,707,943, both to Herzog et al. The rail-unloading machine pulls one or two rails off of the rail train as the rail train moves down the existing track and lays it alongside the existing rails.

Prior art rail trains traditionally comprise of a plurality of sixty-foot-long flatcars connected together by standard railroad couplers. Each car includes a pair of transverse stands for supporting the ribbon rail. The stands of each car are spaced 30 feet apart and 15 feet from the respective coupler such that the stands are spaced 30 feet apart along the length of the rail train. The stands each include multiple tiers (typically five or six tiers) which each support a plurality of rails, for example, eight to twelve rails per tier. The stands must each be strong enough both to support the weight of the rails and to resist side loads created by flexing of the ribbon rails as the rail train traverses curves in the track. Thirty-foot spacing for the stands is believed to be optimal for supporting the rails without excessive sagging.

The rails are loaded or threaded onto the rail train and across the shelves of the racks by a powered drive system. Considerable effort is required to carefully thread each rail into a desired pocket on each shelf. Loading the first rail on each shelf is the most difficult as it is difficult to thread the rail through the desired outer pocket of each rail support shelf, particularly when the rail train is setting on a curved section of track as the end of the rail wants to move in a straight line and the leading end tends to sag.

At least one car in each rail train is a tie-down car including a specialized stand that includes means for fixing the rails to the racks to prevent longitudinal movement of the rails relative to the tie-down car. The fixing means generally includes a plurality of clamping blocks that are bolted to the stand on opposite sides of each rail so as to bear against the foot or base flange of the rail and clamp it against the stand. Typically each clamping block is held down by three or four large bolts which must be installed or removed using an impact wrench or the like. All the other racks in the train allow for relative longitudinal movement of the rails and may include rollers that support the rails. This relative movement between the racks and the rails is required in order to allow the rails to flex without stretching or compressing as the train traverses curves in the track, as well as to allow for coupler slack that exists in each of the couplers between cars.

Each coupler has up to approximately six inches of slack. Coupler slack necessitates that the tie-down car be positioned near the center of the rail train so as to evenly divide the rails and to thereby insure that neither the forward end nor the rearward end of the rail can move a sufficient distance relative to the nearest adjacent rack that the end will fall off of the rack.

At the rearward end of the rail train is an end car from which the rails are unloaded. A rail-unloading machine is typically coupled to the end car and pulls the rails from the end car. The end car includes one or more stands and may include a barrier door rearward of the stand that swings inwardly across the car and acts as a stop to prevent the rails from sliding rearward off the rail train should one or more rails come loose from the tie-down car. The end car may also include a ramp which is pivotally mounted to the deck of the end car rearward of the swing door. The ramp includes a roller on its distal end. The distal end of the ramp can be raised or lowered relative to the deck of the end car and is used to guide the rails upwardly or downwardly as they are being unloaded.

Pickup of used rail follows a similar process. Typically a crane is provided to lift an end of a used ribbon rail and to aid in insertion of the end into a drive mechanism for pulling the rail off of the ground and driving it into a desired pocket in the stands on the a rail train. The used ribbon rails often must be cut to length to fit on the rail train or extended by coupling to a second piece of ribbon rail to fully fill the pocket of the rail train.

Cutting of the ribbon rail by known methods has several drawbacks. Cutting torches are often employed to cut the rail. This presents a potential for igniting fires in the surroundings from contact with the torch flame, dripping slag or molten metal, or with the very hot ends of the rail after cutting, as well as other dangers associated with operation of cutting torches.

Additionally, to cut the ribbon rail by known methods, workers are required to stand near the ribbon rail to operate the cutting torch, saw or other cutting apparatus. This places the worker in danger of being struck by loose ends of the ribbon rail upon completion of the cut because the rail may be under stress, e.g. bending stress that is released when the cut is completed. Further, current rail-pickup machines only provide a single drive apparatus for moving the ribbon rail. As such, after cutting, only one of the two pieces is moveable by the drive apparatus. To move the free piece of ribbon rail a crane is typically provided or the two ends can be rejoined by bolting together until the free piece is moved to a desired position and then the pieces are unbolted.

Extending of the sections of ribbon rail by known methods also has several drawbacks. As described above, current machines only provide a single drive apparatus. Thus, positioning the ends of two sections of ribbon rail together for joining can be difficult and may require workers to manually push or pull the rails by hand or with crowbars.

To join the two sections together a hole is drilled through the web of each of the sections near their abutting ends. A plate that includes similarly positioned holes therethrough is placed on one or both sides of the web and bolts are inserted therethrough. Workers thus must manually drill the holes in the sections of ribbon rail and install the coupling plate and bolts. Misalignment of the holes can result in play or slop in the joint or might require new holes to be drilled to achieve proper fit. And the worker is subject to the dangers of occupying the area near the ribbon rail, such as during movement of the rails to bring them into alignment for joining or resulting from abrupt movements that occur because of other movements of the rail train, workers, and equipment.

Improvements in the functionality and safety of rail loading and unloading machines are needed. It would be advantageous to provide a rail loading and unloading machine with dual drive apparatus positioned on opposite sides of a cutting station for moving opposite sections of a cut ribbon rail. It would also be advantageous to provide cutting and drilling stations that are operable by a worker from a safe vantage point. Additionally, it would be advantageous to provide a drilling station that prepares ribbon rail ends for coupling by simultaneously drilling at least a pair of holes through the web of the rail at designated locations. Further benefit would be realized in a rail loading and unloading machine configured to load or unload ribbon rails on either side of the machine and to simultaneously load, unload, or both load and unload ribbon rails on both sides of the machine.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used in isolation to determine the scope of the claimed subject matter. In brief and at a high level, this disclosure describes, among other things, a rail loading and unloading machine for loading ribbon rail from a ground surface onto a rail train and vice-versa.

The rail loading and unloading machine includes a cab car, a pick-up car, a cross-over car, and a processing car that can be coupled to a rail transport train. The cab car includes a power unit that provides hydraulic, pneumatic and/or electric power to the remainder of the rail loading and unloading machine.

The pick-up car has a longitudinally moveable rail lifting and manipulating apparatus, such as an excavator or crane configured to manipulate ribbon rail from the ground into a first guide box mounted on the pick-up car and into a primary drive unit mounted on the cross-over car. The rail lifting and manipulating apparatus can also aid in placing ribbon rail onto the ground surface during unloading operations. The rail lifting and manipulating apparatus is mounted on a transit rail which includes features along at least one face that are engaged by toothed drive wheels of the rail lifting and manipulating apparatus to provide positive fraction between the rail lifting and manipulating apparatus drive wheels and the transit rail. The rail lifting and manipulating apparatus can thus apply large pulling forces on the ribbon rails.

The first guide box mounted on the pick-up car comprises pairs of rollers mounted to pivot about multiple axes. The rollers are mounted on a pair of arms that open transversely to the ribbon rail to pivot the rollers outwardly and to allow the ribbon rail to be placed therebetween and on a base roller. The arms close to position the rollers over a top flange or head of the ribbon rail and generally abutting at their ends; when abutted at their ends, the two rollers essentially form a single roller that encloses the ribbon rail within the first guide box. The rollers are also mounted to pivot about a transverse axis to enable the rollers to move upward or in a direction away from the base roller. As such, obstructions like joining plates between sections of ribbon rail or other debris on the sides or bottom of the ribbon rails can pass through the first guide box by temporarily displacing the rollers.

The pick-up car is also provided with suspension stabilizing jacks that are selectively extended between the body of the pick-up car and the trucks or wheel assemblies on which the body rides. The stabilizing jacks eliminate movement between the body and the trucks that is allowed by suspension components associated with the truck to stabilize the pick-up car during operation of the rail lifting and manipulating apparatus. Stabilizing jacks might also be provided on one or more of the cab car, crossover car, and processing car to provide stabilization thereof during loading and unloading operations.

The cross-over car includes a primary drive unit useable to drive the ribbon rail along the machine. The primary drive unit is configured with two pairs of drive roller units that can be independently separated to enable ribbon rail that has upset welds or other debris thereon to pass between the rollers. Because each pair of drive roller units is separable independent of the other, one pair can be separated to allow the debris on the rail to pass through while the second pair drives the rail through the primary drive unit.

The primary drive unit is further configured to rotate side-to-side, pivot vertically, and move horizontally transverse to the crossover car to aid directing of the ribbon rail. A cross-over guide assembly is also provided to direct the ribbon rail toward a desired side of the machine or along a desired processing path.

A cutting station, drilling station, second guide box, secondary drive unit, and second crane are disposed on the processing car. These apparatus are remotely operable by a worker using controls disposed in an elevated operator's booth or from a secondary station. The secondary drive unit is located opposite the cutting station from the primary drive unit to enable movement of two separate sections of ribbon rail on opposite sides of the cutting station simultaneously. The secondary drive unit is also configured with independently separable pairs of rollers that enable passage of debris on the ribbon rail through the secondary drive unit, and the secondary drive unit can rotate side-to-side, pivot vertically, and move both horizontally and vertically to direct the ribbon rail.

The drill station is disposed on a retractable table that is normally concealed beneath the deck of the processing car. Upon actuation, the drill station is configured to raise, engage and clamp the ends of ribbon rail sections, drill at least two holes simultaneously, and retract automatically. A worker can then install joining plates and bolts using the drilled holes while standing on a cover panel disposed over the retracted drilling station.

The rail loading and unloading machine is provided with redundant components disposed on opposite sides of the cars to enable loading and unloading from either side. The loading and unloading operations can be completed one at a time or simultaneously.

DESCRIPTION OF THE DRAWINGS

Illustrative embodiments of the invention are described in detail below with reference to the attached drawing figures, and wherein.

DETAILED DESCRIPTION

Figure 1:
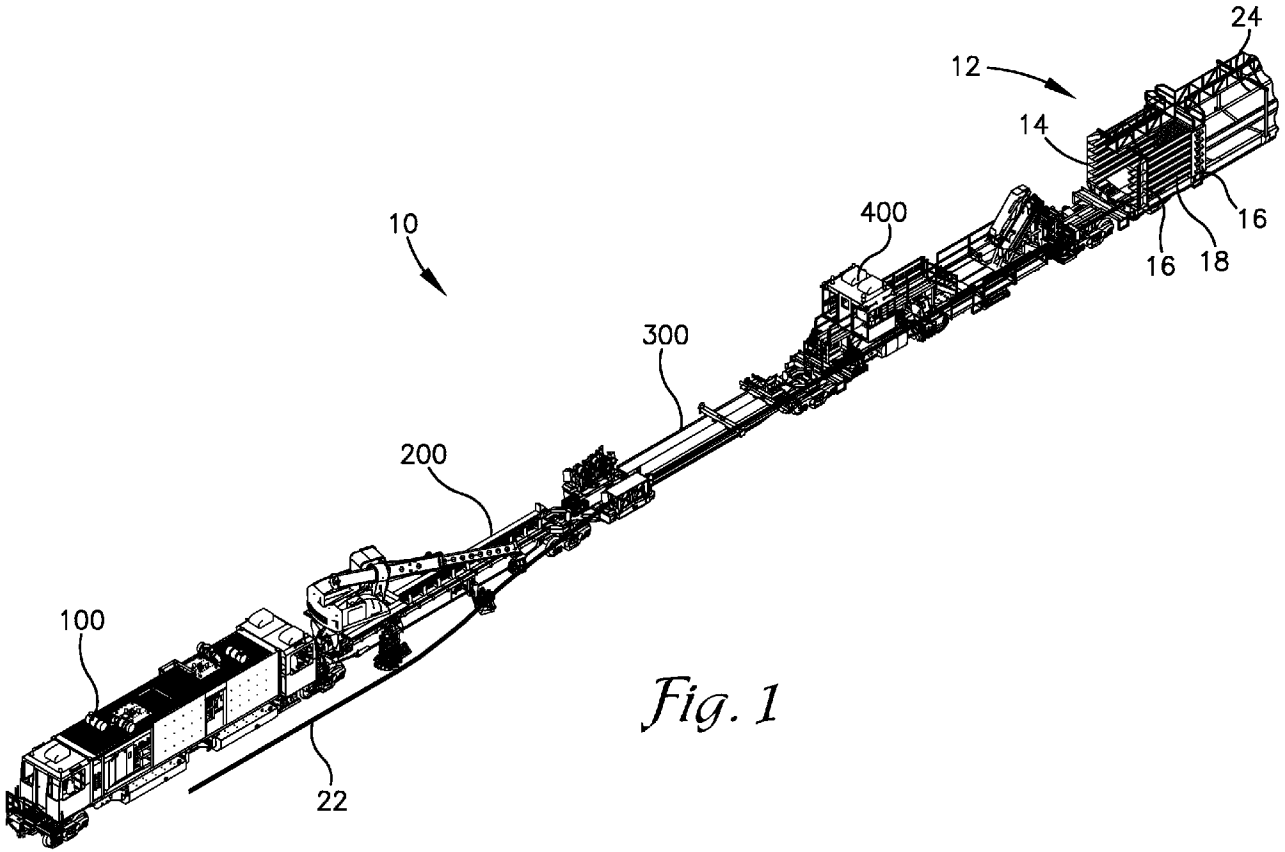
FIG. 1 is a perspective view of a rail loading and unloading machine showing a fragment of an end car of a rail transport train coupled thereto in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

With reference now to the drawings, a rail loading and unloading machine 10 (also interchangeably referred to herein as the machine 10) is described in accordance with embodiments of the invention. For clarity, this description is divided into subsections directed to a cab car 100, a pick-up car 200, a crossover car 300, a processing car 400, and operation of the rail loading and unloading machine 10. Reference numerals are also broken into hundreds series corresponding to the car 100, 200, 300, 400 with respect to which the particular components are described. Such is intended to provide clarity to this description of embodiments of the invention and not to be limiting. For example, components provided with a 100-series reference numeral and described with respect to the cab car 100 might be disposed on the pick-up car 200 or another car or, one or more of the cars 100, 200, 300, 400 might be combined or further subdivided without departing from the scope of embodiments described herein.

Certain terminology is used in the description herein for convenience only and is not to be limiting. Terms like front, rear, forward, and rearward are used herein to describe embodiments of the invention with the cab car 100 being positioned at and defining the front or forward end of the machine 10 and the processing car 400 being positioned at and defining the rearward end of the machine 10. Forward and rearward directions are defined accordingly. It is to be understood that this convention is the reverse of the convention used for rail trains which are pulled by a locomotive positioned at the front of the rail train and have an end car configured for loading or unloading of rail located at their rearward end. The "rear" of the machine 10, i.e. the rear of the processing car 400, may thus be connected to the "rear" or end car of the rail train and the machine 10 may be pulled in a "rearward" direction by the locomotive. Direction of travel of the machine 10 varies and is primarily determined by the operating condition of the machine, such as whether rail is being loaded onto a rail train, unloaded off of a rail train, or whether the machine is in transit. Terms like up, down, vertical, and horizontal are used with respect to the horizon and common understandings of the terms.

As depicted in FIG. 1, the rail loading and unloading machine 10 comprises a cab car 100, a pick-up car 200, a crossover car 300, and a processing car 400. The machine 10 might also include or be coupled to a rail transport train 12, such as the rail transport trains of the prior art described previously or may be used in conjunction with an embodiment of the rail train described in U.S. Pat. No. 8,181,577 entitled "Rail Train" and assigned to Herzog Contracting Corp. of St. Joseph, Mo. The rail transport train 12 includes a plurality of rail support cars 14 that each includes one or more transversely oriented stands 16. The stands 16 provide a plurality of horizontal shelves 18 divided into a plurality of pockets configured to receive a ribbon rail 22. Ribbon rail 22 is well known in the prior art and includes a somewhat rounded head 46 formed at its upper end and a substantially planar foot 50 formed at its lower end. The head 46 and foot 50 are spaced apart by a generally vertical web 48. As known in the art, the stands 16 of traditional rail trains are typically spaced about fifteen feet from each end of a sixty-foot-long rail car 14 and thus about thirty feet apart. Alternatively, the rail train 12 may be made up of thirty foot cars 14 with a single stand 16 each, which configuration also provides the standard thirty foot spacing between stands 16. An end car 24 positioned at the rearward end of the rail train 12 may be coupled to the processing car 400 by known coupling means or draw bars, and may include an additional loading/unloading stand disposed at a front end thereof to aid feeding of the ribbon rails 22 onto the rail transport train 12. The end car 24 and/or loading/unloading stand 26 can include additional components or features that aid workers in inserting or withdrawing ribbon rails 22 from the rail transport train 12. Further detail of the rail transport train 12 is not essential to the description or understanding of the rail loading and unloading machine 10 of embodiments of the invention and is not further described here.

The cars 100, 200, 300, 400 of embodiments of the invention are each constructed on a similar car body 28 or spine weldment assembly. The bodies 28 of each of the cars 100, 200, 300, 400 are referred to generally herein as the body 28. Such is not intended to indicate that all of the bodies 28 are identical, rather, each of the bodies 28 is similar but is specifically configured for components disposed on the respective cars 100, 200, 300, 400. The bodies 28 generally comprise a manufactured center beam extending between a pair of wheel assemblies or trucks 30. The bodies 28 may have one or more lateral supports extending from one or both sides of the center beam to support structures disposed on top of the body 28. In another embodiment (not shown), a flat-car-type body or other configuration might be employed. The bodies 28 may also include various features to enable routing of hydraulic and/or electrical lines from one car 100, 200, 300, 400 to the next and between components mounted on a single car 100, 200, 300, 400. Such lines can be routed through the body 28 and along surfaces thereof, among other placements.

The bodies 28 are provided with a shared-truck configuration in which a single truck 30 is shared between adjacent cars 100, 200, 300, 400. As such, the cab car 100 includes a dedicated truck 31 at the front end that only supports the cab car 100 and shares a truck 30 with the pick-up car 200, the pick-up car 200 and the crossover car 300 have shared trucks 30 at each end thereof, and the processing car 400 includes a shared truck 30 on its front end and a dedicated truck 31 at its rear end. The cars 100, 200, 300, 400 are thus coupled together via the shared trucks 30. The cars 100, 200, 300, 400 might alternatively be configured without shared trucks 30, e.g. with two dedicated trucks 31 each, and be coupled by a standard coupler or draw bar. The front end of the cab car 100 and the rear end of the processing car 400 can include standard couplers or draw bars for coupling to other rail cars and/or the rail transport train 12.

Figure 2B:
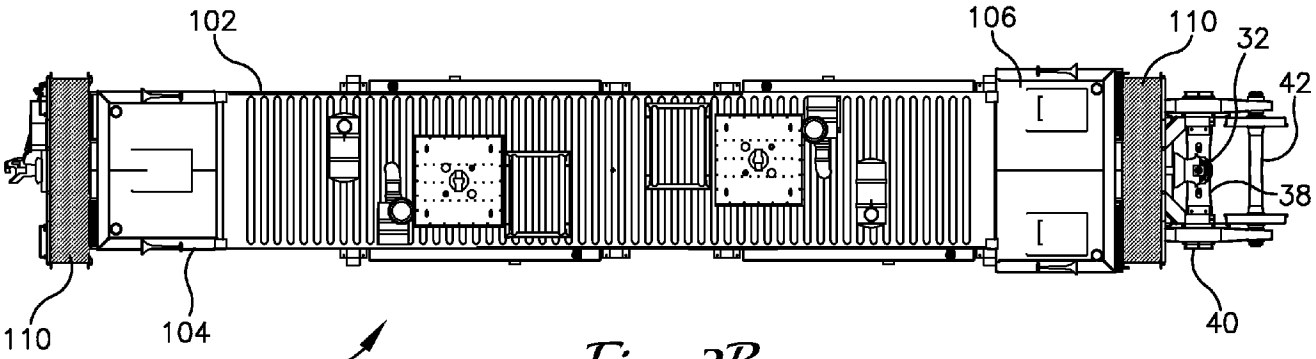
FIG. 2B is a top plan view of the cab car of FIG. 2A.
Figure 2A:
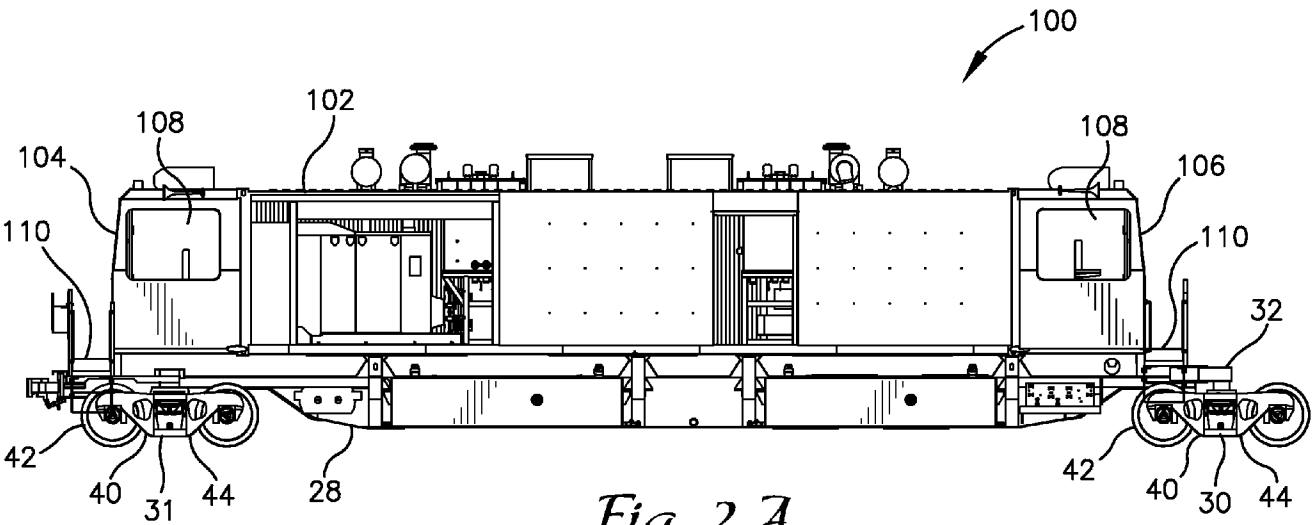
FIG. 2A is a side elevational view of a cab car of the rail loading and unloading machine of FIG. 1.
Figure 3A:
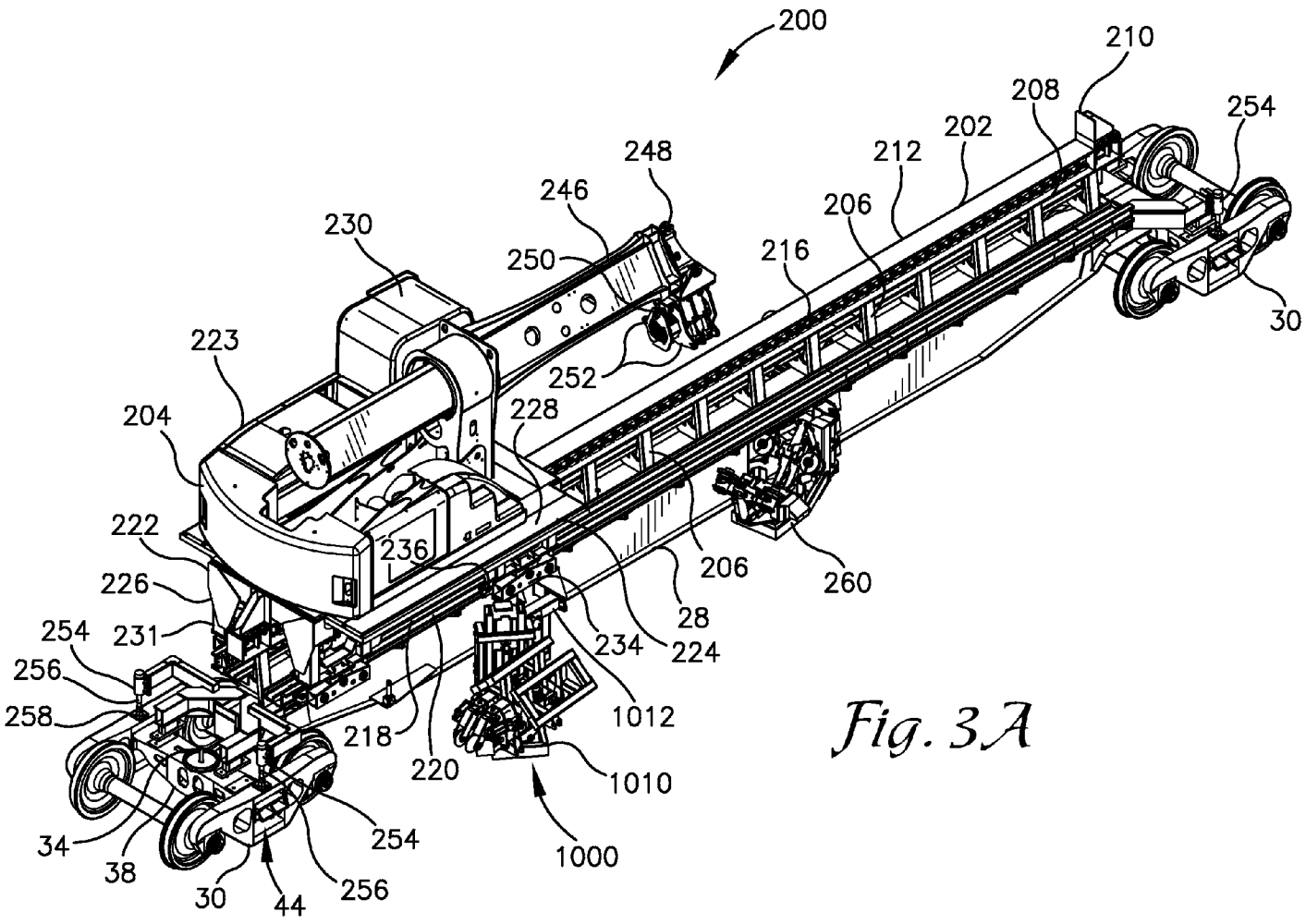
FIG. 3A is perspective view of a pick-up car of the rail loading and unloading machine of FIG. 1.
Figure 3C:
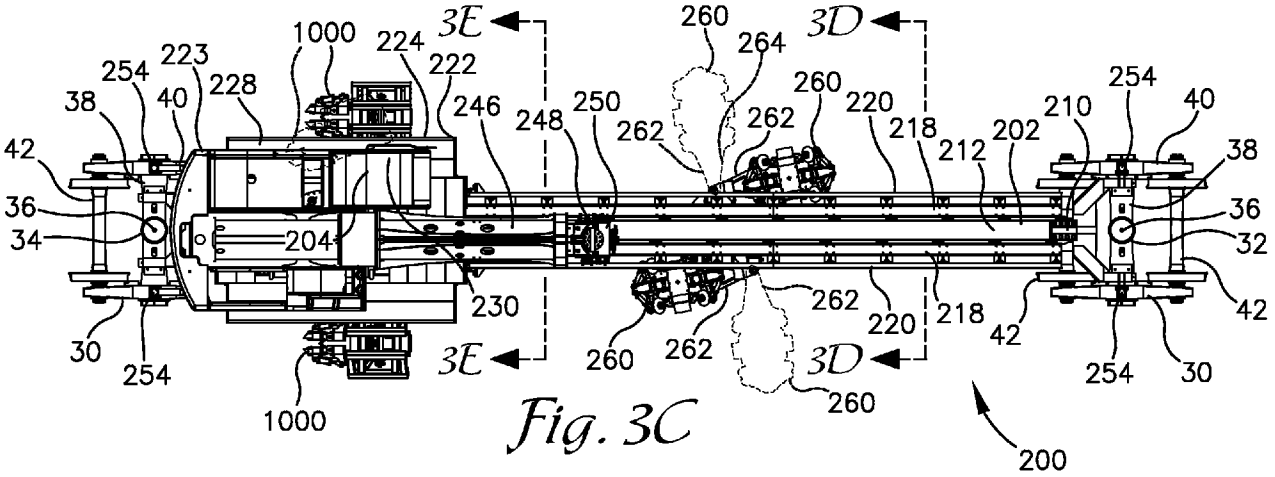
FIG. 3C is a top plan view of the pick-up car of FIG. 3A.

Adjacent ends of the bodies 28 of the cars 100, 200, 300, 400 are configured to rotatably couple together and to the shared trucks 30 using a clevis-and-tang-style arrangement. For example, as depicted in FIGS. 2A-B, the cab car 100 includes a clevis 32 at its rear end and, as depicted in FIGS. 3A and 3C, the pick-up car 200 includes a tang 34 at its front end. The tang 34 is inserted between the arms of the clevis 32 and a rod 36, clevis pin, or other component is inserted through aligned apertures in the clevis 32 and tang 34. The rod 36 is affixed to and extends vertically upward from a cross member 38 of a frame 38 of the truck 30 or the rod 36 might insert through an aperture in the frame 38. The coupling enables the cab car 100 and the pick-up car 200 to pivot with respect to one another about the rod 26 and allows the truck 30 to rotate about the rod 36. Other methods of coupling the cars 100, 200, 300, 400 to a shared truck 30 can be used in embodiments of the invention.

The trucks 30 also include a pair of axle assemblies 42 and a suspension system 44 as known in the art. The suspension system 44 includes a plurality of components, such as coil springs or leaf springs that enable the cross member 38 and thus the body 28 coupled thereto to at least partially pivot or lean away from a vertical alignment with the trucks 30 and to at least partially absorb vibrations and bumps resulting from loads applied to the body 28 and/or to the trucks 30.

A variety of components are coupled to or mounted on the cars 200, 300, 400 for loading and unloading the ribbon rails 22 from the rail transport train 14 as described in greater detail below. Some of these components are mounted in pairs with one component on each side, e.g. left or right side of the respective car 200, 300, 400. In one embodiment, the components that are mounted on one side are all painted a first color and the components mounted on the opposite side are painted a second color, e.g. components on the right side of the cars are painted blue and components on the left side are painted red. Control systems, including stations, buttons, monitors, levers, and etc. for these components can also be similarly color-coded. This color-coding increases safety for workers operating the components because there is a reduced likelihood that the wrong component or control system therefor would be activated which could result in injury to the workers or damage to the machine 10. The color-coding also makes communications regarding the components easier and more definite because the color-coding is easy to understand. For example, a worker that is instructed to operate "the blue drive box" knows exactly what component he or she is supposed to operate. In contrast, a worker instructed to operate "the drive box on the right" may be unsure whether "right" is in reference to the speaker, the worker, or the machine 10.

Cab Car

Referring to FIGS. 2A and 2B, the cab car 100 provides hydraulic and/or electrical power to the machine 10. The cab car 100 includes an enclosure 102 mounted atop the car body 28. A forward cab 104 and a rear cab 106 are included at opposite ends of the enclosure 102. The forward and rear cabs 104, 106 provide stations at which workers can control operations of the cab car 100 and other components of the machine 10. Two stations 108 are provided side-by-side in each of the cabs 104, 106 to enable operation of the cab car 100 and/or other components of the machine 10 from either the right or left side of the cab car 100. The stations 108 can include redundant controls for operation of various functions of the machine 10 or the controls might be side specific, e.g. the controls are configured to control apparatus mounted on the same side of the machine 10 as the respective station 108. Further, the controls can be configured to operate apparatus on one or more of the cars 100, 200, 300, 400 as described more fully below.

A variety of components are housed by the enclosure 102 between the cabs 104, 106. For example, one or more electric, diesel, or gas engines and generators can be disposed in the enclosure 102 for providing electrical power to the cab car 100 and to the remainder of the cars 200, 300, 400 and any cars coupled thereto like, for example, the rail transport train 12. Hydraulic pumps and fluid reservoirs might also be disposed in the enclosure 102 for operation of hydraulic apparatus on the cab car 100 or the cars 200, 300, and 400.

Figure 3B:
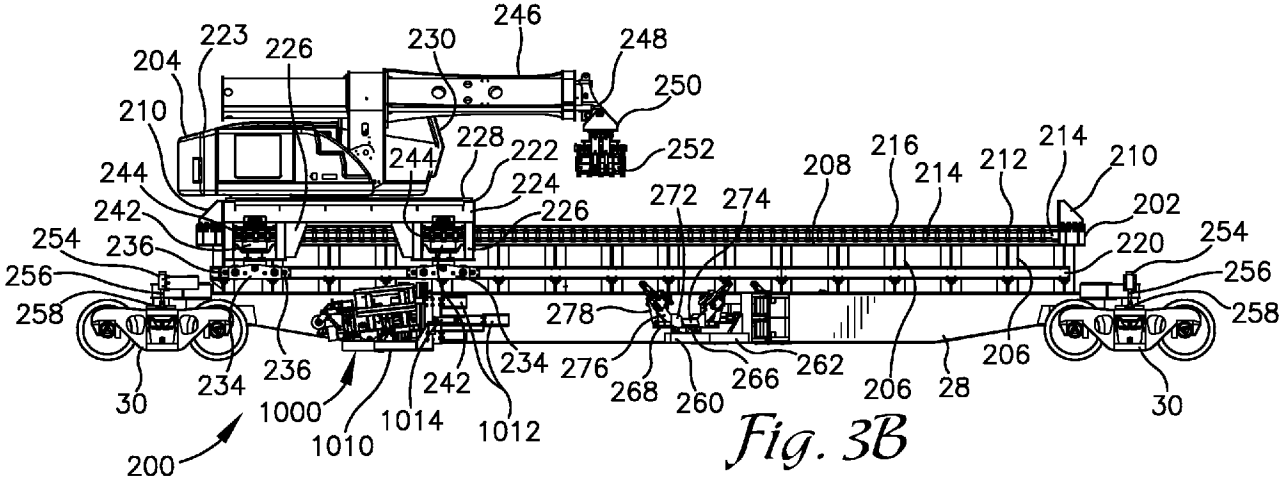
FIG. 3B is a side elevational view of the pick-up car of FIG. 3A.
Figure 3D:
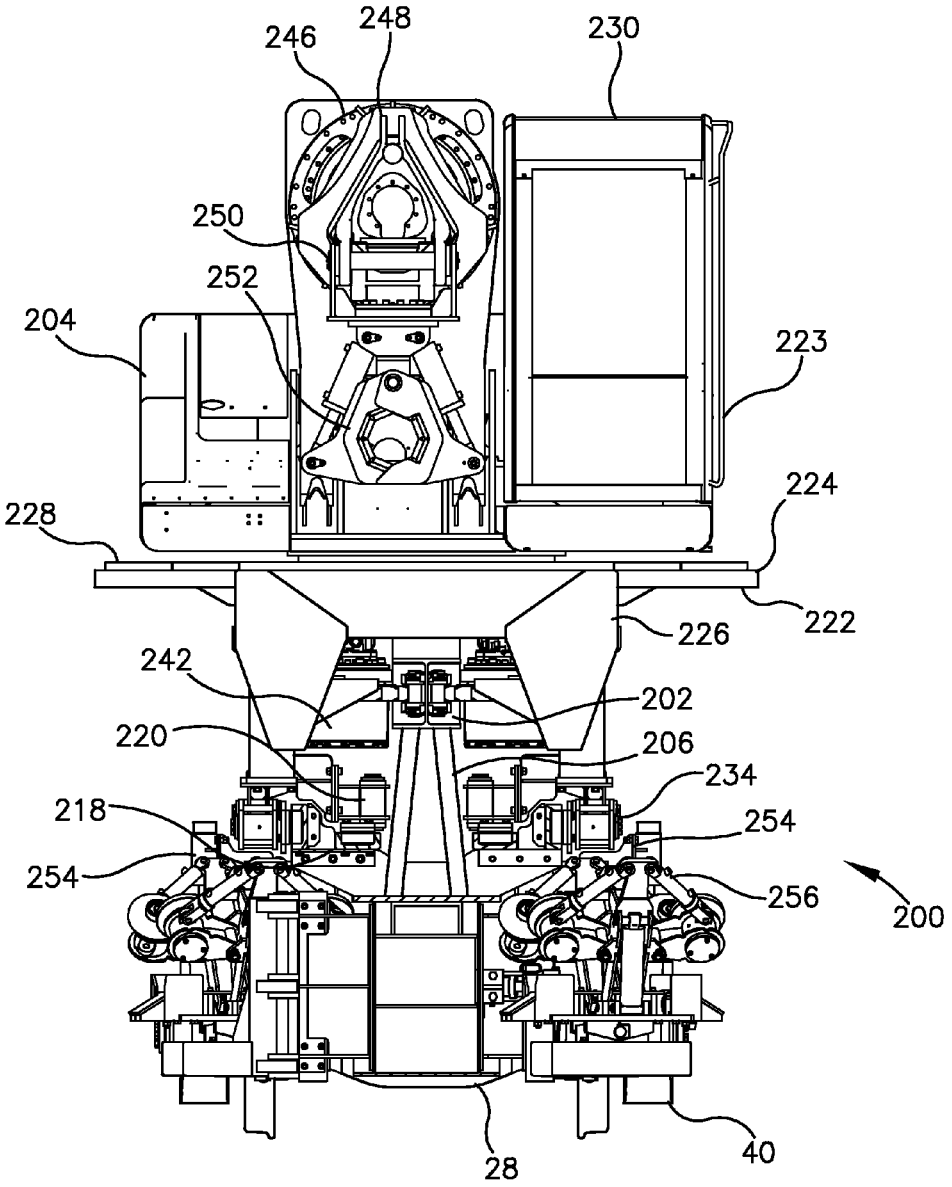
FIG. 3D is a cross-sectional view of the pick-up car taken along line 3D-3D in FIG. 3C.

A walkway 110 is provided outside each of the cabs 104, 106 to enable access to the cabs 104, 106. As depicted in FIGS. 3A-B, the walkways 110 are disposed transversely along the front and rear of the enclosure 102 but might extend along the sides or around the full perimeter of the enclosure 102.

As described previously, the cab car 100 includes a dedicated truck 31 at its front end and a shared truck 30 at the rear end thereof for coupling to the pick-up car 200. The dedicated truck 31 is a free-wheeled truck to allow a locomotive coupled to the machine 10 or rail train 12 to move the machine 10 along the tracks or could comprise a powered truck that is operably coupled to one or more of the engines disposed in the enclosure 102 to move the machine 10.

The cab car 102 can house a variety of other components, supplies, and compartments as desired in embodiments of the invention. For example, a galley, sleeping quarters, water supply storage, workspace, tool chest, or the like can be constructed on the cab car 100 or in the enclosure 102. Although, a particular configuration of the cab car 100 is described and depicted herein, such is not intended to be limiting. Other configurations are foreseen and are within the scope described herein.

Pick-Up Car

Referring to FIGS. 3A-3E, the pick-up car 200 is configured to pick up the ribbon rail 22 from locations alongside the machine 10 for loading onto the rail transport train 12 and/or to aid in offloading the ribbon rail 22 from the rail transport train 12. The pick-up car 200 includes an elevated transit rail 202 on which a rail lifting and manipulating apparatus 204, such as a crane or excavator, is mounted. The transit rail 202 is vertically elevated above and centrally positioned along the length of the body 28 of the pick-up car 200 on a plurality of support members 206. The transit rail 202 comprises an I- or H-beam having a bottom flange 208, top flange 212 and web 214 (see FIG. 3E). The bottom flange 208 of the transit rail is coupled to the support members 206. A bump stop 210 is coupled to the top flange 212 of the transit rail 202 at each end thereof.

One or both sides of the web 214 of the transit rail 202 include a traction feature like, for example, a section of chain 216. The chain 216 may be, for example, a roller chain, drive chain, or transmission chain similar to that used in a drive system of a crane or other heavy equipment vehicle. The chain 216 extends substantially along the length of the transit rail 202 and is welded or otherwise affixed to the web 214. The traction feature might alternatively comprise a gear face like that of a rack in a rack-and-pinion assembly, teeth attached to the web 214, recesses or apertures in the web 214, or similar features that are affixed to the web 214 or integral therewith.

Horizontal and vertical support rails 218, 220 are mounted on the body 28 of the pick-up car 200 on each side of the transit rail 202 and extending parallel thereto. The support rails 218, 220 comprise C-shaped members or channels that are configured to at least partially support loads associated with the rail lifting and manipulating apparatus 204. The support rails 218, 220 also guide movements of the rail lifting and manipulating apparatus 204 in a direction parallel to the transit rail 202. The horizontal support rails 218 are disposed with the open portion of the C-shape oriented vertically upward and, the vertical support rails 220 are oriented with the open portion of the C-shape directed horizontally outward from the transit rail 202. However, other orientations are useable in embodiments of the invention.

The rail lifting and manipulating apparatus 204 includes a mounting sled or bogie 222 disposed on the transit rail 202 and a body 223 rotatably mounted to the bogie 222. The bogie 222 includes a horizontally disposed platform 224 with legs 226 extending vertically downward therefrom proximate each corner thereof. The platform 224 is configured to rotatably couple to the body 203 and to support the rail lifting and manipulating apparatus 204 on the transit rail 202. The platform 224 may include one or more walkways 228 on a top surface thereof on which an operator can stand to gain access to a cab 230 of the rail lifting and manipulating apparatus 204. One or more bearing surfaces 231 or rollers can be disposed on an underside of the platform 224 and between the platform 224 and the top flange 212 of the transit rail 202. The bearing surfaces 231 support the platform 224 on the transit rail 202 and aid sliding of the platform 224 along the top flange 212 of the transit rail 202. Lubricants such as grease, oil, or the like can be applied between the bearing surfaces 231 and the transit rail 202.

One or more vertically oriented stabilizing rollers 232 are mounted on each of the legs 226 at a distal end thereof for receipt by the vertical support rails 220. One or more horizontally oriented stabilizing rollers 233 are also mounted at the distal ends of each of the legs 226 for receipt by the horizontal support rails 218. As depicted in FIGS. 3A-B, four vertically oriented stabilizing rollers 232 are provided on a vertical guide assembly 234 that is disposed at the distal end of each leg 226. The vertical guide assembly 234 is comprised of an elongate body 235 and a pair of pivot plates 236. The elongate body 235 is pivotally coupled at its midpoint to the leg 226 and each of the pivot plates 236 are pivotally coupled to opposite ends of the body 235. Each of the vertically oriented stabilizing rollers 232 is rotatably affixed to a respective end of one of the pivot plates 236.

Figure 3E:
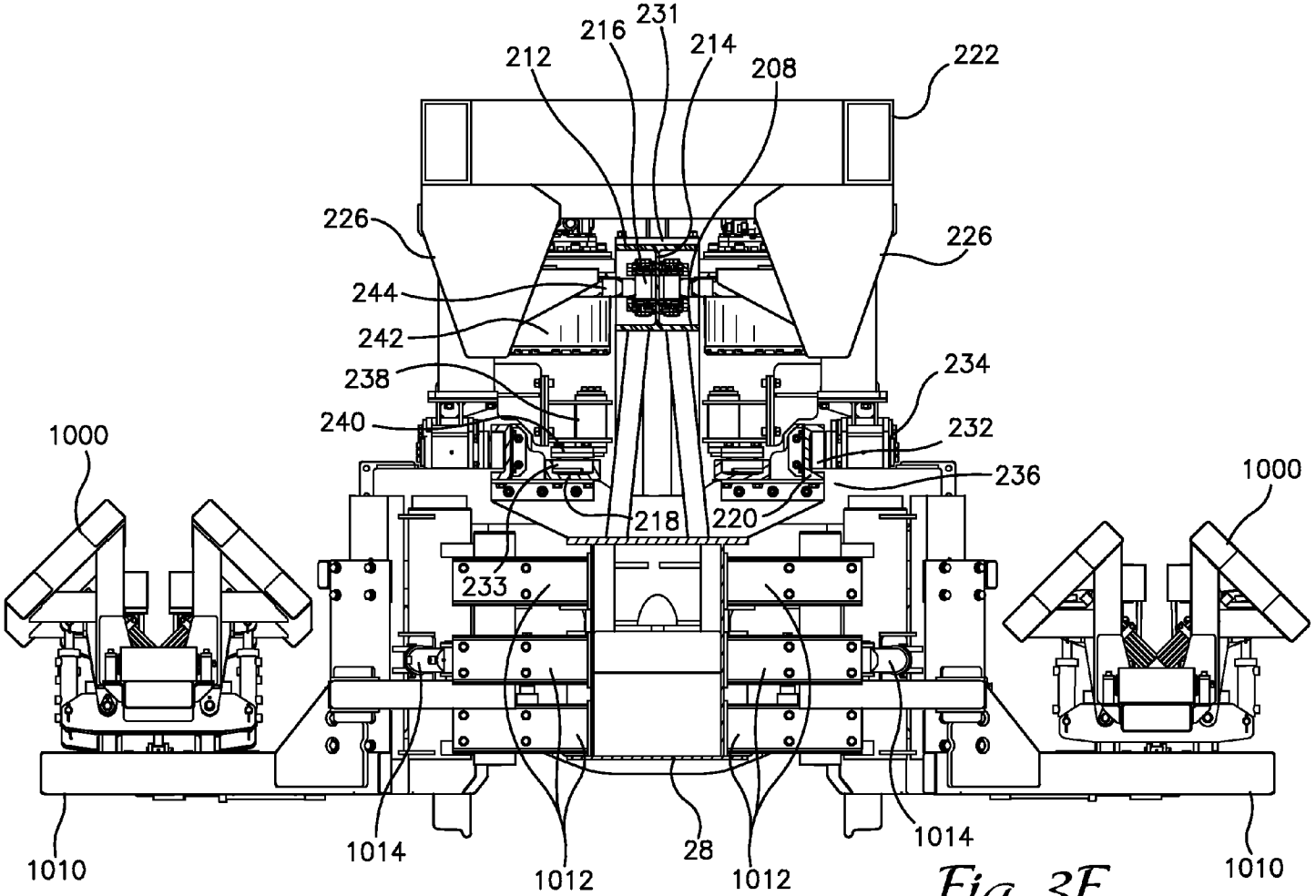
FIG. 3E is a cross-sectional view of the pick-up car taken generally along line 3E-3E in FIG. 3C.

Referring to FIG. 3E, the vertically oriented stabilizing rollers 232 are received in the vertical support rail 220 to provide vertical support to the bogie 222 and to resist upward movement by the bogie 222 away from the vertical support rails 220 and the transit rail 202. Further, the vertical support rails 220 are oppositely oriented on each side of the transit rail 202 such that the open faces of the C-shape are directed in opposite directions; the engagement of the stabilizing rollers 232 on each of the legs 226 with the vertical support rails 220 on both sides of the transit rail 202 thus resists horizontal and rotational movements of the bogie 222 with respect to the transit rail 202.

The horizontally oriented stabilizing rollers 233 are similarly coupled to a horizontal guide assembly 238 disposed at the distal end of each of the legs 226. The coupling of the horizontal guide assembly 238 to the leg 226 is pivotal about a midpoint along the horizontal guide assembly 238. A stabilizing roller 233 is disposed at each end of the horizontal guide assembly 238. Pivot plates, like the pivot plates 236 of the vertical guide assembly 234 can be employed in the horizontal guide assembly 238 but are not shown. The horizontally oriented stabilizing rollers 233 are received by the horizontal support rails 218 and resist horizontal and rotational movements of the bogie 222 about the transit rail 202.

A drive motor 242 is coupled to each leg 226, or adjacent thereto, beneath the platform 224. The drive motors 242 comprise hydraulic, electric, or other motors or propulsion systems configurable to drive the rail lifting and manipulating device 204 along the transit rail 202. The drive motors 242 each operably mount a horizontally disposed drive wheel or a toothed cogwheel 244 that engages the chain 216 coupled to the web 214 of the transit rail 202. The engagement of the cogwheel 244 with the chain 216 provides a positive mechanical engagement between the cogwheels 244 and the transit rail 202 that does not rely on friction for traction and that cannot slip.

This configuration may greatly increase the amount of pulling force that can be applied by the rail lifting and manipulating apparatus 204 over designs known in the art. Known designs employ rubber or similar drive wheels on a generally smooth surface, such as the web of a beam or gantry rail. The pulling force that can be achieved by these known designs suffers and is limited by the traction that can be achieved between the rubber wheels and the smooth surface. For example, cranes using such designs are limited to about 20,000 pounds of tractive effort or force that can be applied. In contrast, embodiments of the invention have been found to provide greater than about 80,000 pounds of tractive effort or force.

The body 205 of the rail lifting and manipulating apparatus 204 preferably comprises a diesel powered, hydraulically actuated crane or excavator body having multiple axes of movement and rotation. One example of such a machine is the GRADALL XL4200 hydraulic excavator from Gradall Industries, Inc. of New Philadelphia, Ohio, which can be modified for mounting on the bogie 222. It is to be understood, however, that other cranes or excavating machinery 204 can be employed and/or modified for use with the pick-up car 200 without departing from the scope of embodiments of the invention. The rail lifting and manipulating apparatus 204 is powered by one or more onboard engines, motors, pumps, or the like or can be provided with electrical and/or hydraulic power from the engines and generators disposed in the cab car 100, as described above.

The body 205 is rotatable with respect to the bogie 222 about a vertical axis and the entire rail lifting and manipulating apparatus is moveable end-to-end along the transit rail 202 via the bogie 222. A boom 246 on the body 205 of the rail lifting and manipulating apparatus 204 can be vertically pivoted to raise and lower an end 248 of the boom 246 and extended and retracted to move the end 248 inwardly and outwardly relative to the pick-up car 200. An advantage of the Gradall machine is that the boom 246, in addition to having the capability of being telescoped to extend the end 248, is that it can also be rotated about an axis extending coaxially through the boom 246. In other embodiments (not shown), the rail lifting and manipulating apparatus 204 might have more or fewer available movements and axes of rotation depending on a particular crane or excavator that is chosen and any optional equipment thereon.

An end-arm tool 250 is coupled to the end 248 of the boom 246. The end-arm tool 250 is freely pivotable about a coupling with the end 248 of the boom 246 or one or more hydraulic actuators can be coupled between the boom 246 and the tool 250 to control positioning of the tool 250. The end-arm tool 250 is selectable and/or configurable for a particular job to be completed. As depicted in FIGS. 3A-B, the end-arm tool 250 comprises a grapple with a set of hydraulically actuated jaws 252. The jaws 252 can be positioned around a section of ribbon rail 22 and closed to grasp the ribbon rail 22 for lifting and/or pulling by the rail lifting and manipulating apparatus 204. The jaws 252 can be configured to twist the ribbon rail 22 into an upright position, e.g. with a top flange or head 46 of the rail 22 positioned vertically above a web 48 of the rail 22, as the jaws 252 close around the rail 22. For example, the jaws 252 can include an interior profile that tends to rotate the rail 22 into an upright position with respect to the end-arm tool 250 as the jaws 252 close around the rail 22. The end-arm tool 250 can also be manipulated by the rail lifting and manipulating apparatus 204 to twist the rail 22 into such an upright orientation. Other end-arm tools 250 like buckets, jackhammers, sheers, or the like might also be employed for various applications.

An operator's cab 230 is provided on the rail lifting and manipulating apparatus 204 for operation of the rail lifting and manipulating apparatus 204 but, remote control is also possible. Controls for the rail lifting and manipulating apparatus 204 can be provided in the rear cab 106 of the cab car 100 or at an operator's station located on one of the cars 300, 400 (such as described below) to enable an operator to manipulate the rail lifting and manipulating apparatus 204 from one of those stations. A wireless radio control station might also be provided.

Stabilizing jacks 254 are included on the pick-up car 200 to prevent or reduce movement of the body 28 of the pick-up car 200 with respect to the trucks 30 during operation of the rail lifting and manipulating apparatus 204. During such operation, the suspension system 44 of the trucks 30 allows the body 28 to lean and/or bounce which may lead to instability and dangerous conditions for operation of the rail lifting and manipulating apparatus 204. For example, when lifting a section of ribbon rail 22 from along the right side of the pick-up car 200, the car 200 may lean or list toward the right side due to the additional weight and/or forces from the rail lifting and manipulating apparatus 204. If this listing is too great the car 200 might become unstable and topple over. The cab car 100, crossover car 300, and processing car 400 might also be fitted with one or more stabilizing jacks 254 in embodiments of the machine 10.

The stabilizing jacks 254 reduce or eliminate the ability of the body 28 to lean or list by providing a rigid connection between the body 28 and the frame 40 of the trucks 30. The stabilizing jacks 254 comprise hydraulic, pneumatic, or mechanical actuators mounted on the body 28 of the pick-up car 200. The stabilizing jacks 254 are mounted at each corner of the car 200 in locations that are vertically above the frames 40 of the trucks 30. When actuated, pistons 256 extend into contact with the frames 40 of the trucks 30 and rigidly maintain the orientation and spacing between the body 28 and frames 40 of the trucks 30. Because the suspension components 44 of the trucks 30 provide suspension between the trucks 30 and the body 28, e.g. not between the trucks 30 and the axle assemblies 42, the ability of the body 28 to move via the suspension components 44 is eliminated by the stabilizing jacks 254.

A foot 258 can be disposed on the distal end of each of the pistons 258 to provide a larger contact surface between the pistons 258 and the respective truck 30. A mating feature, pad, or fixture (not shown) can be provided on the truck frame 40 to receive or engage the respective foot 258 and or the end of the respective piston 256 for additional support. An opposite configuration in which the stabilizing jacks 254 are mounted on the trucks 30 and extend to contact the body 28 can also be employed without departing from the scope of embodiments of the invention described herein. In another embodiment, the stabilizing jacks 254 extend from the body 28 to the rails on which the machine 10 rests or to the ground beneath the machine 10.

Guide boxes 260 are coupled to each side of the body 28 of the pick-up car 200. The guide boxes 260 are configured to receive the ribbon rail 22 to be loaded onto the machine 10 from the ground or other surface adjacent the machine and to direct the rail 22 toward components mounted on the cross-over car 300 as described below. The guide boxes 260 might also guide rail 22 being offloaded by the machine 10.

Each of the guide boxes 260 is mounted on a distal end of a retractable arm 262 to enable the guide boxes 260 to be retracted to a stowed position adjacent to the body 28, as depicted in FIGS. 3A-D, or extended to an operational position extending generally transversely to the body 28, as depicted in phantom line in FIG. 3C. A proximal end of the arm 262 is pivotably coupled to the body 28 of the pick-up car 200 such that the arm 262 pivots about a vertical axis extending through the coupling with the body 28. A hydraulic actuator 264 is coupled between the body 28 and the arm 262 at a point spaced apart from the proximal end of the arm 262. The actuator 264 is operable to pivot the arm 262 and, thus, the guide box 260 between the stowed and operational positions. In other embodiments (not shown), a carriage can be installed between the guide box 260 and the arm 162 to enable the vertical and/or horizontal position of the guide box 260 to be adjusted, e.g. the carriage can enable the guide box 260 to be raised or lowered and/or extended further from the body 28 of the pick-up car 200. It is also to be understood that the arm 162 could be articulated to provide additional ranges of movement to the guide box 260.

As depicted in best in FIGS. 4A-D, the guide box 260 is coupled to the distal end of the arm 262 by a swivel mount assembly 266 that enables rotation of the guide box 260 about a generally vertical axis and pivoting of the guide box 260 about a generally horizontal axis. Rotation and pivoting of the guide box 260 using the swivel mount assembly 266 is controlled by one or more actuators coupled between the guide box 260 and the arm 262, among other ways. The guide box 260 can thus guide the rail 22 or can be manipulated to steer the rail 22.

Additionally, a system controlling the one or more actuators coupled between the guide box 260 and the arm 262 or other components may include a float setting. The float setting relaxes or relieves hydraulic pressure on the actuators to enable the guide box 260 to be moved, pivoted, or turned by forces applied thereon via the ribbon rail 22, workers, or the rail lifting and manipulating apparatus 204. As such, with the float setting engaged, the guide box 260 can freely adjust its position and/or orientation to reduce binding and/or tension on the ribbon rail 22, the guide box 260, and other associated components, With continued reference to FIGS. 4A-D, the guide box 260 comprises a baseplate 268 affixed to a top surface of the swivel mount assembly 266. A pair of base rollers 270 is rotatably mounted to the baseplate 268 in side-by-side relation transverse to a longitudinal centerline of the baseplate 268. Guide plates 272 are mounted on each side of the pair of rollers 270. The guide plates 272 each include a ramp 274 positioned to guide the ribbon rail 22 over the guide plate 272 and over the base rollers 270. The guide plates 272 and base rollers 270 define a path 275 along the centerline of the baseplate 268 and following the direction of rotation of the base rollers 270 over which the ribbon rail 22 can pass through the guide box 260.

Figure 4A:
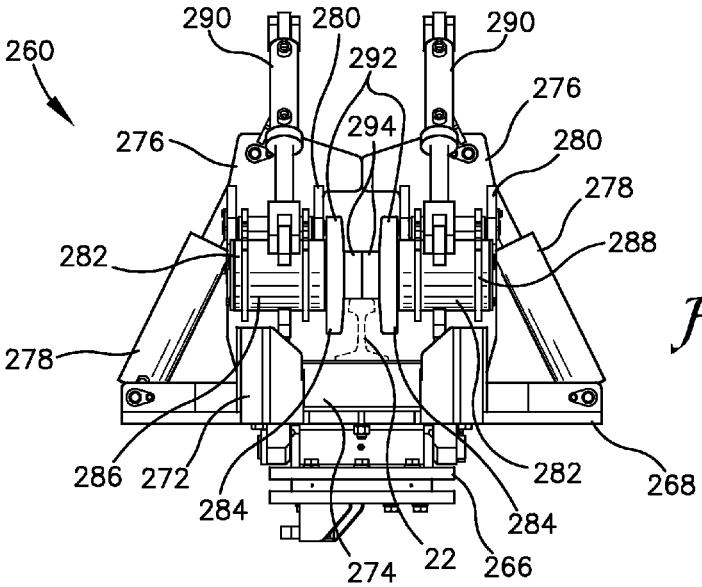
FIG. 4A is an end elevational view of a guide box depicted in accordance with an embodiment of the invention.
Figure 4B:
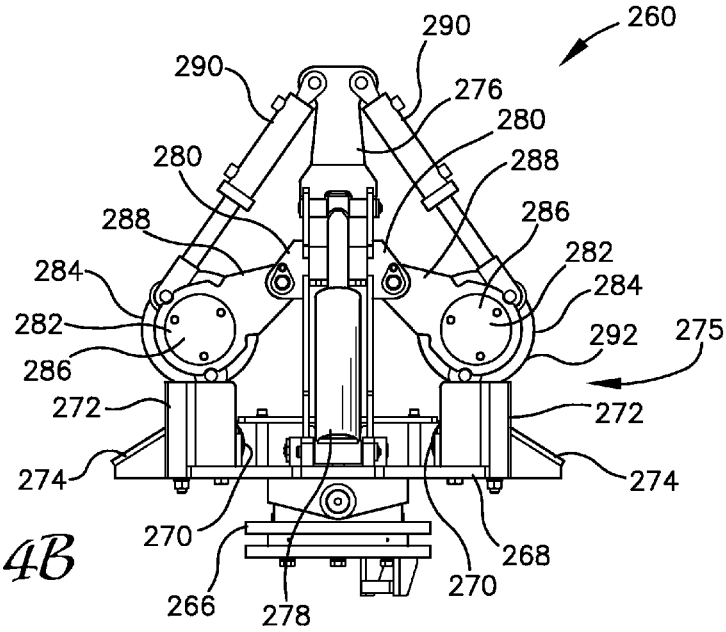
FIG. 4B is a side elevational view of the guide box of FIG. 4A.
Figure 4C:
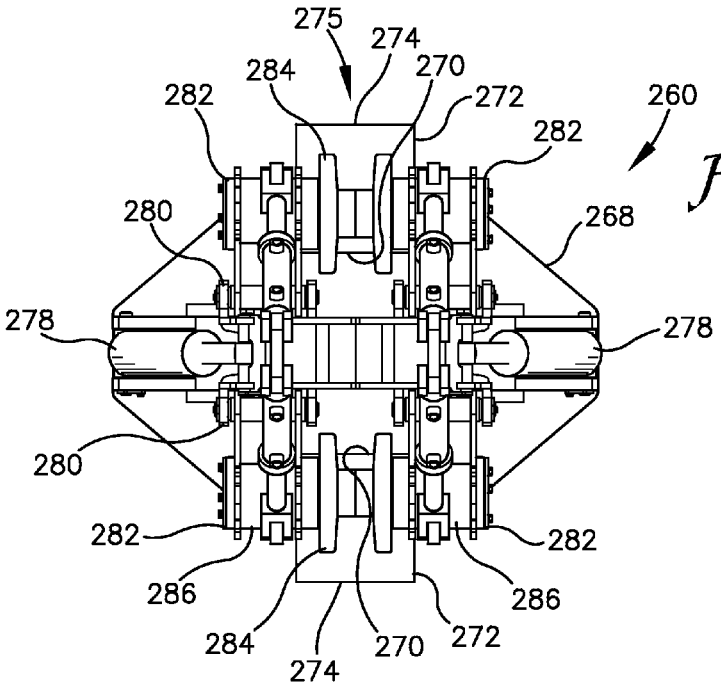
FIG. 4C is a top plan view of the guide box of FIG. 4A.
Figure 4D:
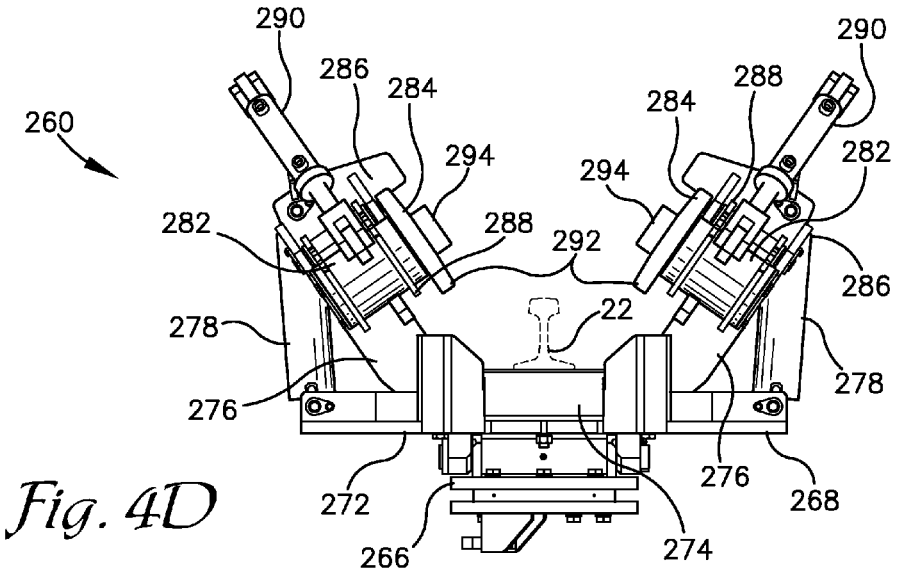
FIG. 4D is an end elevational view of the guide box of FIG. 4A depicted in an open position.
Figure 4E:
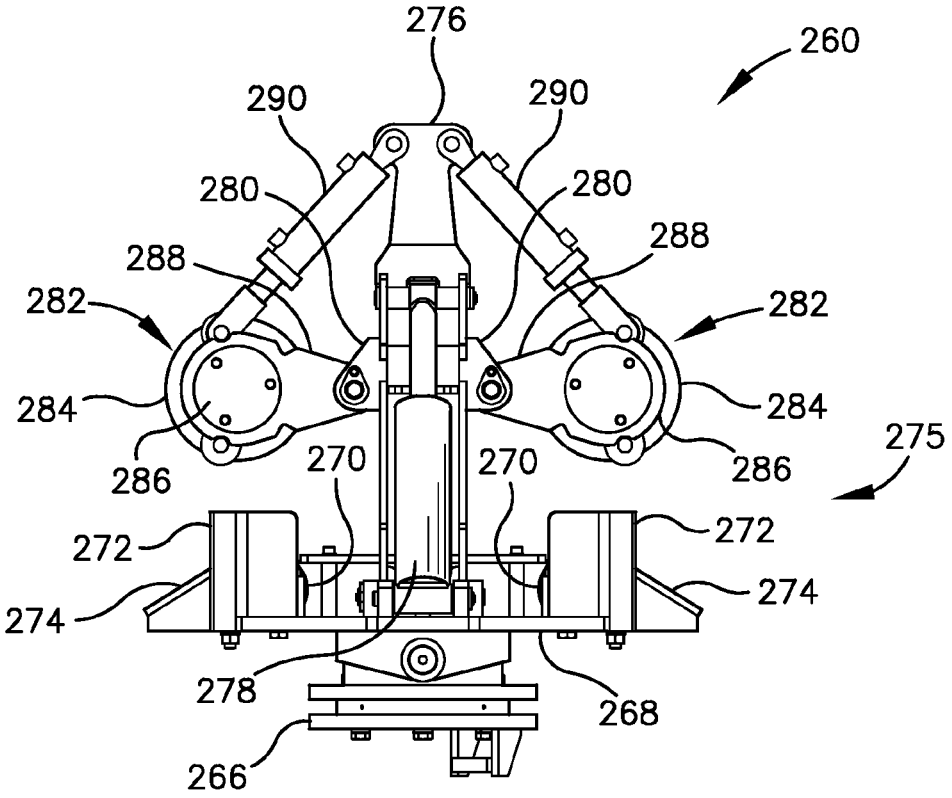
FIG. 4E is a side elevational view of the guide box of FIG. 4A depicting roller assemblies pivoted upwardly to enable passage of obstructions through the guide box in accordance with an embodiment of the invention.

A pair of jaws 276 are hingedly mounted on the baseplate 268 adjacent opposite ends of the base rollers 270 and configured to pivot about jaw axes parallel to the path 275. Hydraulic actuators 278 are coupled between the baseplate 268 and each of the jaws 276 to pivot the jaws about their couplings with the baseplate 268 from a substantially vertical, closed position (FIGS. 4A-C) to an open position in which the jaws 276 lean outward and away from the path 275 (FIG. 4D). In the open position the jaws 276 pivot to a wide angel with respect to one another to provide a maximum distance therebetween to ease placement of the ribbon rail 22 on the base rollers 270 by, for example, the rail lifting and manipulating apparatus 204. The wide angle is between approximately 30° and 180° or preferably between approximately 45° and 120° or more preferably approximately about 90°.

Respective pairs of ears 280 extend from each opposed sides of each of the jaws 276 parallel to the path 275. Each pair of ears 280 provides a mounting location for a roller assembly 282. Each roller assembly 282 includes a roller 284, a roller housing 286, and a pivot arm 288. Each roller 284 is rotatably disposed in and extends from an end of the respective roller housing 286. Each pivot arm 288 extends radially outward from the respective roller housing 286 and pivotably couples to the respective pair of ears 280 to allow the roller assembly 282 to pivot about an arm axis that is generally perpendicular to the length of the jaw 276 and to the path 275.

A hydraulic actuator 290 is coupled between each roller housing 286 and a distal end of the respective jaw 276. The actuator 290 can pivot the roller assemblies 280 about the respective couplings with the ears 280 to press the rollers 284 toward the ribbon rail 22 disposed in the guide box 260 or to raise the rollers 284 away from the ribbon rail 22. By including an accumulator (not shown) in the hydraulic system for the actuators 290, the actuator 290 can also be configured to function as shock absorbers to allow the ribbon rail 22 and obstructions thereon to force the roller assemblies 282 upwards and away from the baseplate 268 to allow the ribbon rail 22 and the obstructions to pass through the guide box 260 as described more fully below. The actuators 290 can also be used to pivot the rollers 284 toward or away from the baseplate 268 to accept ribbon rail 22 of varied heights.

Each of the rollers 284 of the roller assemblies 282 extends from an end of the respective roller assembly 282 nearest to the path 275. The rollers 284 each include a first segment 292 that is proximate to the respective roller housing 286 and a second segment 294 between the first segment 292 and the distal end of the roller 284. The first segment 292 has a radius that is larger than that of the second segment 287 and forms a flange which extends radially outward past the second segment 287. The second segment 287 has a length measured along its axis of rotation that is approximately one half of the width of the head 46 of the ribbon rail 22 with accommodation for a desired tolerance.

The distal end of the second segment 287 of the roller 284 is configured to abut or to come into close proximity to the distal end of the roller 284 mounted on the opposite jaw 276 when the jaws 276 are pivoted to the closed position. As such, the opposing rollers 284 come together to essentially form a single roller with their second segments 294 over the head 46 of the ribbon rail 22 disposed in the guide box 260. Their first segments 292 extend along and beyond the sides of the head 46 of the ribbon rail 22 to enclose the head 46 within a channel formed by the first and second segments 292, 294 of the rollers 284. Thereby, the ribbon rail 22 can be contained between the rollers 284 and the base rollers 270 to guide the ribbon rail 22 as it is pushed or drawn through the guide box 260 toward downstream components or locations.

Figure 10:
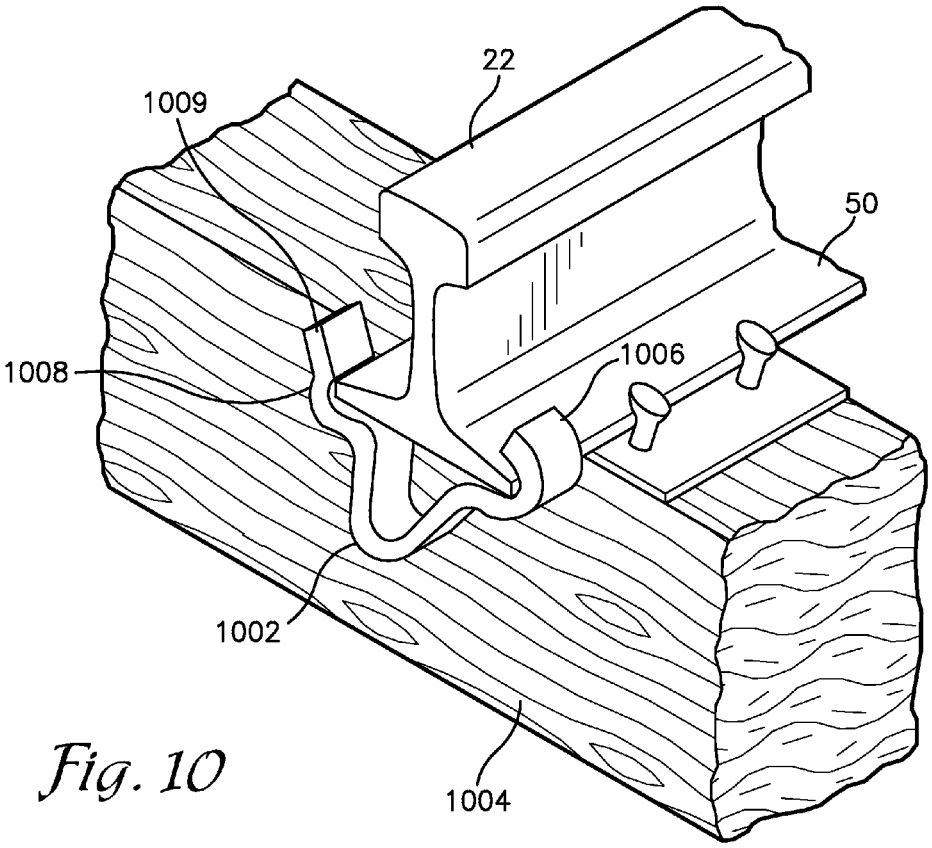
FIG. 10 is a perspective view of a ribbon rail with a rail anchor coupled to the foot thereof.
Figure 11A:
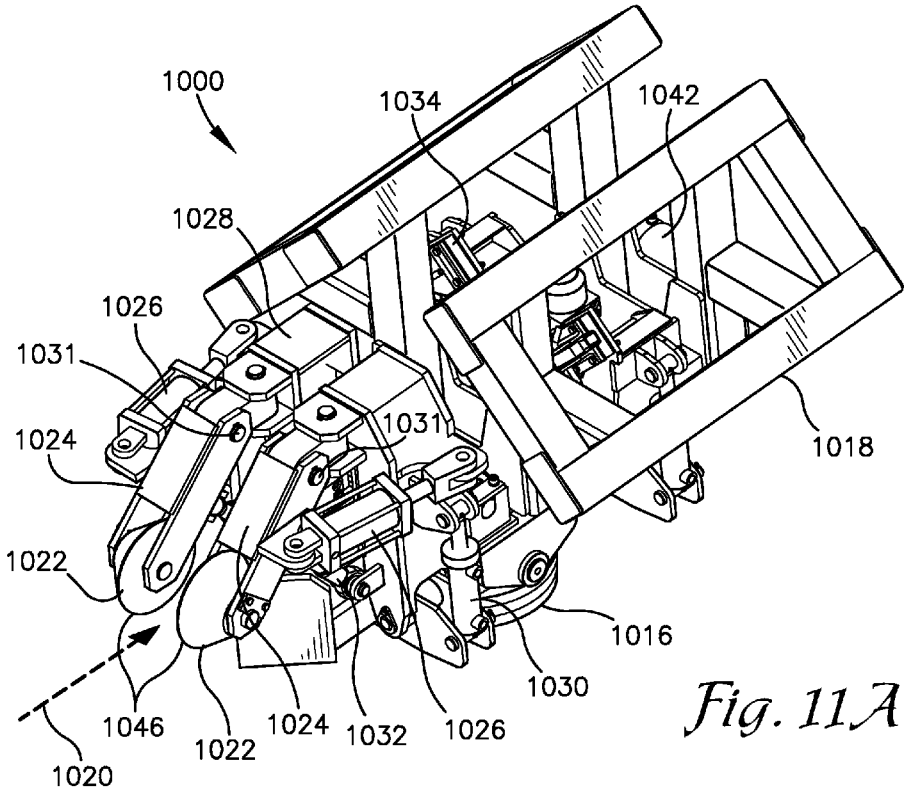
FIG. 11A is an enlarged partially exploded perspective view of an anchor removing apparatus mounted on the pick-up car of FIG. 3A.
Figure 11B:
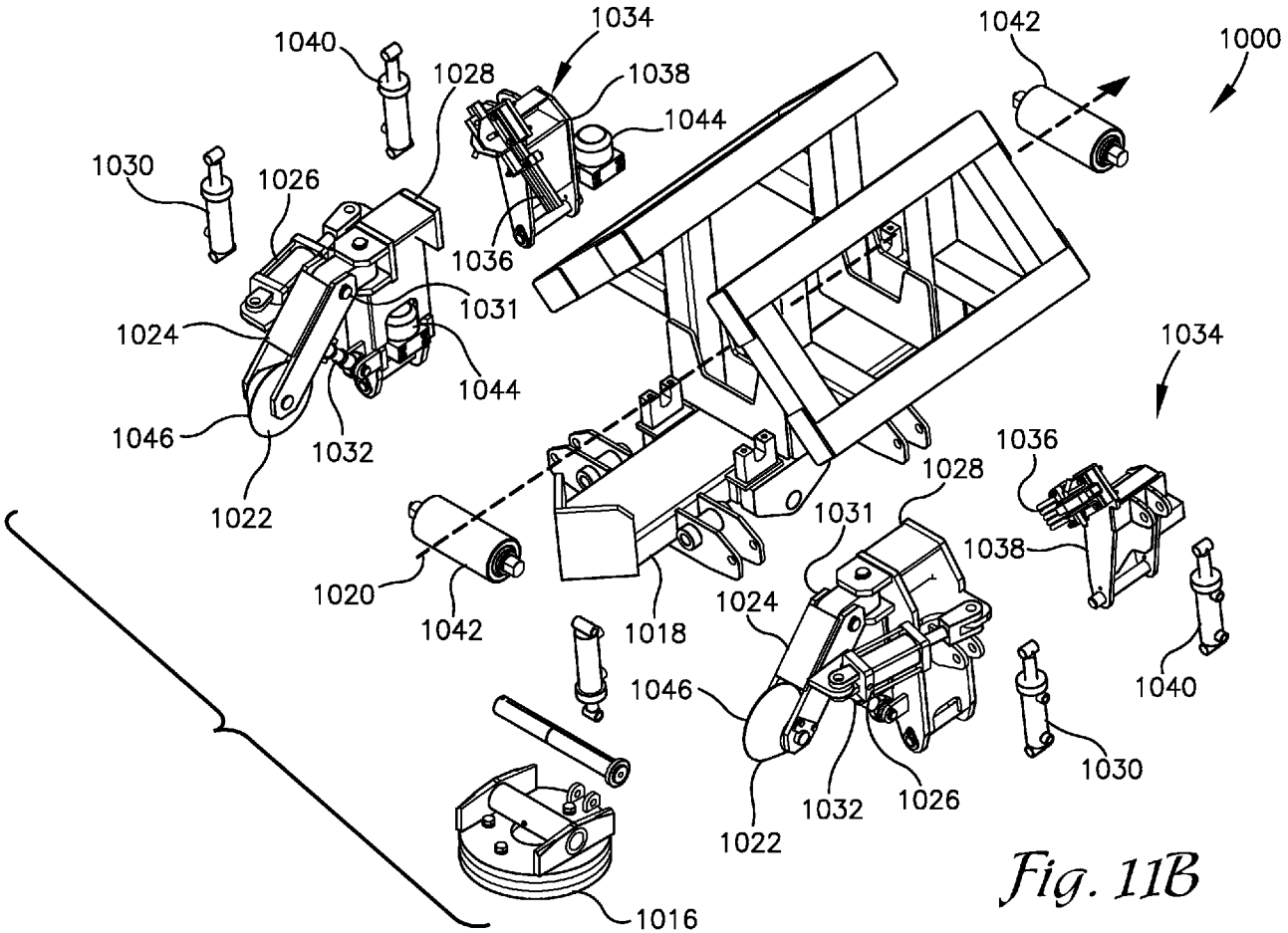
FIG. 11B is an exploded view of the anchor removing apparatus of FIG. 11A.

Referring again to FIGS. 3A-C and E and to FIGS. 11A-B, respective anchor-removing apparatuses 1000 can be mounted on opposing sides of the body 28 of the pick-up car 200 for removing rail anchors 1002 from the ribbon rails 22 for loading by the machine 10. Rail anchors 1002, as known in the art and depicted in FIG. 10, comprise a clip that is installed beneath and between opposite sides of the foot 50 of the ribbon rail 22. The clip abuts a side of a tie 1004 on which the rail 22 sits to resist longitudinal movement of the rail 22 under rail traffic and expansion or contraction of the rail 22. A first end 1006 of the anchor 1002 wraps or hooks at least partially around an edge of the foot 50 to engage the foot 50. The anchor 1002 is expanded to engage an opposite second end 1008 with an opposite edge of the foot 50 and to thereby maintain the anchor 1002 in tension and in engagement with the foot 50 of the rail 22. The opposite second end 1008 typically includes a flange 1009 that extends away from the rail 22 at an angle to aid installation/removal of the anchor 1002 on the rail 22. Upon removal of the ribbon rails 22 from an installed position, the anchors 1002 often remain coupled thereto and should be removed before placing the rail 22 on the rail-transport train 12.

Each of the anchor-removing apparatuses 1000 is mounted on a pivotable carriage 1010 to enable the anchor-removing apparatus 1000 to be retracted to a stowed position adjacent to the body 28 or extended to an operational position extending at an angle to the body 28, as depicted in FIGS. 3A-C and E. A proximal end of the carriage 1010 is pivotably coupled to a support structure 1012 on the body 28 of the pick-up car 200 such that the carriage 1010 pivots about a vertical axis extending through the coupling with the support structure 1012. A hydraulic actuator 1014 is coupled between the support structure 1012 or the body 28 and the carriage 1010. The actuator 1014 is operable to pivot the carriage 1010 and, thus, the anchor-removing apparatus 1000 between the stowed and operational positions.

The carriage 1010 also enables the vertical and/or horizontal position of the anchor-removing apparatus 1000 to be adjusted, e.g. the carriage 1010 enables the anchor-removing apparatus 1000 to be raised or lowered and/or extended further from the body 28 of the pick-up car 200. It is also to be understood that the carriage 1010 or an additional support structure could be articulated to provide additional ranges of movement to the anchor-removing apparatus 1000.

As depicted best in FIGS. 11A-B, the anchor-removing apparatus 1000 is coupled to the carriage 1010 by a swivel mount assembly 1016 that enables rotation of the anchor-removing apparatus 1000 about a generally vertical axis and pivoting of the anchor-removing apparatus 1000 about a generally horizontal axis. Rotation and pivoting of the anchor-removing apparatus 1000 using the swivel mount assembly 1016 is controlled by one or more actuators coupled between the swivel mount 1016 and the carriage 1010, among other ways. The anchor-removing apparatus 1000 can thus be positioned to receive the rail 22 as it is moved from a surface adjacent to the pick-up car 200 toward the cross-over car 300. Additionally, a system controlling the one or more actuators coupled between the anchor-removing apparatus 1000 and the carriage 1010 or other components may include a float setting similar to that described above with respect to the guide box 260.

With continued reference to FIGS. 11A-B, the anchor-removing apparatus 1000 comprises a frame 1018 that forms an elongate central path 1020 along which the rail 22 travels through the anchor-removing apparatus 1000. The frame 1018 is open above the central path 1020 to allow admission of the rail 22 into the central path 1020. A leading end of the path 1020 is flanked on each side by a pair of wedge rollers 1022. Each of the wedge rollers 1022 comprises a generally horizontally disposed frusto-conical roller which is rotatably coupled to a distal end of a pivot arm 1024. Each pivot arm 1024 is pivotally coupled to an upper or distal end of a respective roller jaw 1028, which is in turn pivotally connected to the frame 1018 at its lower or proximate end. Each jaw roller 1028 is pivotable about an axis parallel to the central path 1020 so as to be moveable between a substantially vertical closed position and an outwardly extending open position. An actuator 1026 is disposed between each pivot arm 1024 and the respective roller jaw 1028 to pivot the arm 1024 about an axis which is substantially parallel to the roller jaw 1028 and to thereby move the respective wedge roller 1022 toward or away from the central path 1020 or a rail 22 disposed therein when the roller jaw 1028 is in the closed position. A respective actuator 1030 is disposed between the frame 1018 and each roller jaw 1028 to pivot the roller jaw 1028 between the open and closed positions.

Each pivot arm 1024 includes a transverse pivot joint 1031 which allows the pivot arm 1024 to bend about an axis generally parallel to the axis of rotation of the respective wedge roller 1022. A respective connecting rod 1032 is disposed between each pivot arm 1024 and the respective roller jaw 1028 to restrict pivotal movement of the arm 1024 about its pivot joint 1031. Each connecting rod 1032 includes a rod end bearing at each end thereof which are threadably coupled to the connecting rod 1032 to enable adjustment of the length of the connecting rod 1032 and thus an angle of orientation of the arm 1024.

The anchor-removing apparatus 1000 also includes a pair of sweeping units 1034 disposed on each side of the central path 1020 downstream from the wedge rollers 1022. The sweeping units 1034 each comprise a set of fingers 1036 disposed on an upper end of a carrier arm 1038. Each carrier arm 1038 is pivotally coupled to the frame 1018 at an opposite lower end. Each sweeping unit 1034 further includes an actuator 1040 for pivoting the carrier arm 1038 about a horizontal axis to move the upper end thereof toward/away from a rail 22 disposed in the anchor-removing apparatus 1000. The fingers 1036 are disposed at an angle, e.g. approximately 45° to vertical and directed toward the central path 1020. As such, the carrier arm 1038 can be pivoted toward the central path 1020 and a rail 22 disposed therein to bring the fingers 1036 into contact or close proximity to the foot 50 of the rail 22.

The anchor-removing apparatus 1000 may also include one or more horizontal rollers 1042 disposed on the frame 1018 beneath the central path 1020 upon which a rail 22 can travel through the apparatus 1000. A plurality of vertical rollers 1044 may also be provided along each side of the central path 1020 to aid travel of a rail 22 within the central path 1020.

In operation, the anchor-removing apparatus 1000 is moved from the stowed position to the operational position by the actuator 1014 and/or operation of the carriage 1010. A ribbon rail 22 is fed or placed into the central path 1020 using the crane 204. Or the anchor-removing apparatus 1000 might be manipulated to engage a rail 22 extending alongside the pick-up car 200.

The roller jaw 1028 and pivot arm 1024 associated with the wedge roller 1022 disposed on the same side of the rail 22 as the second end 1008 of the anchors 1002 are actuated to move the wedge roller 1022 toward the web 48 of the rail 22. An edge 1046 of the wedge roller 1022 is moved into contact or into close proximity with the foot 50 of the rail 22. The wedge roller 1022 can be positioned near or over an edge of the foot 50 or might be positioned alongside the edge of the foot 50 such that the wedge roller 1022 is aligned to engage anchors 1002 attached to the rail 22 as the rail 22 travels along the central path 1020 through the anchor-removing apparatus.

Upon engagement of the wedge roller 1022 with an anchor 1002, the wedge roller 1022 contacts the flange 1009 extending from the second end 1008 of the anchor 1002 to flex the second end 1008 outwardly and away from the rail 22. The second end 1008 of the anchor 1002 is thus disengaged from the foot 50 of the rail 22.

One or both sweeping units 1034 are also actuated to move the fingers 1036 toward the foot 50 of the rail 22. The fingers 1036 are positioned in contact or adjacent to the edge of the foot 50 so as to obstruct passage of the first end 1006 of the anchor 1002. When both sweeping units 1034 are employed the fingers 1036 are moved to obstruct the passage of both the first and second ends 1006, 1008 of the anchors 1002. As such, the fingers 1036 contact the first end 1006 of the anchor 1002 as the anchor 1002 and the rail 22 pass through the anchor-removing apparatus 1000. The contact with the anchor 1002 disengages the first end 1006 from the foot 50 of the rail 22. Because the second end 1008 of the anchor 1002 is first disengaged from the rail 22 by the wedge roller 1022, disengagement of the first end 1006 from the rail 22 frees the anchor 1002 from the rail 22 and allows the anchor 1002 to fall away to a collection container or to the ground below.

The inclusion of a wedge roller 1022 and sweeping unit 1034 on each side of the central path 1020 enables processing of rails 22 having anchor 1002 disposed in either possible orientation. This may be beneficial when rails 22 are removed from an installed position and laid on an opposite side of the track location.

Crossover Car

Referring to FIGS. 5A-5E, the crossover car 300 is coupled behind the pick-up car 200 via a shared truck 30 as described previously above. The crossover car 300 comprises a body 28 with a pair of primary drive units 302, a support roller assembly 304, and a crossover guide assembly 306 mounted thereon. Walkway platforms 307 can also be installed extending from and along sides of the body 28. The primary drive units 302 are mounted on opposite sides of the body 28 near the front end thereof. As both of the drive units 302 are similarly mounted and configured, the following description thereof is provided with reference to one of the drive units 302 for clarity.

A pair of support arms 308 extends from the side of the body 28 in a direction generally transverse to the body 28. A support track 310 is affixed to the opposing faces of each of the support arms 308, e.g. on sides of the support arms 308 that face one another. A mounting assembly 312 is slideably disposed between the support arms 308 and engaging the support tracks 310.

Figure 5A:
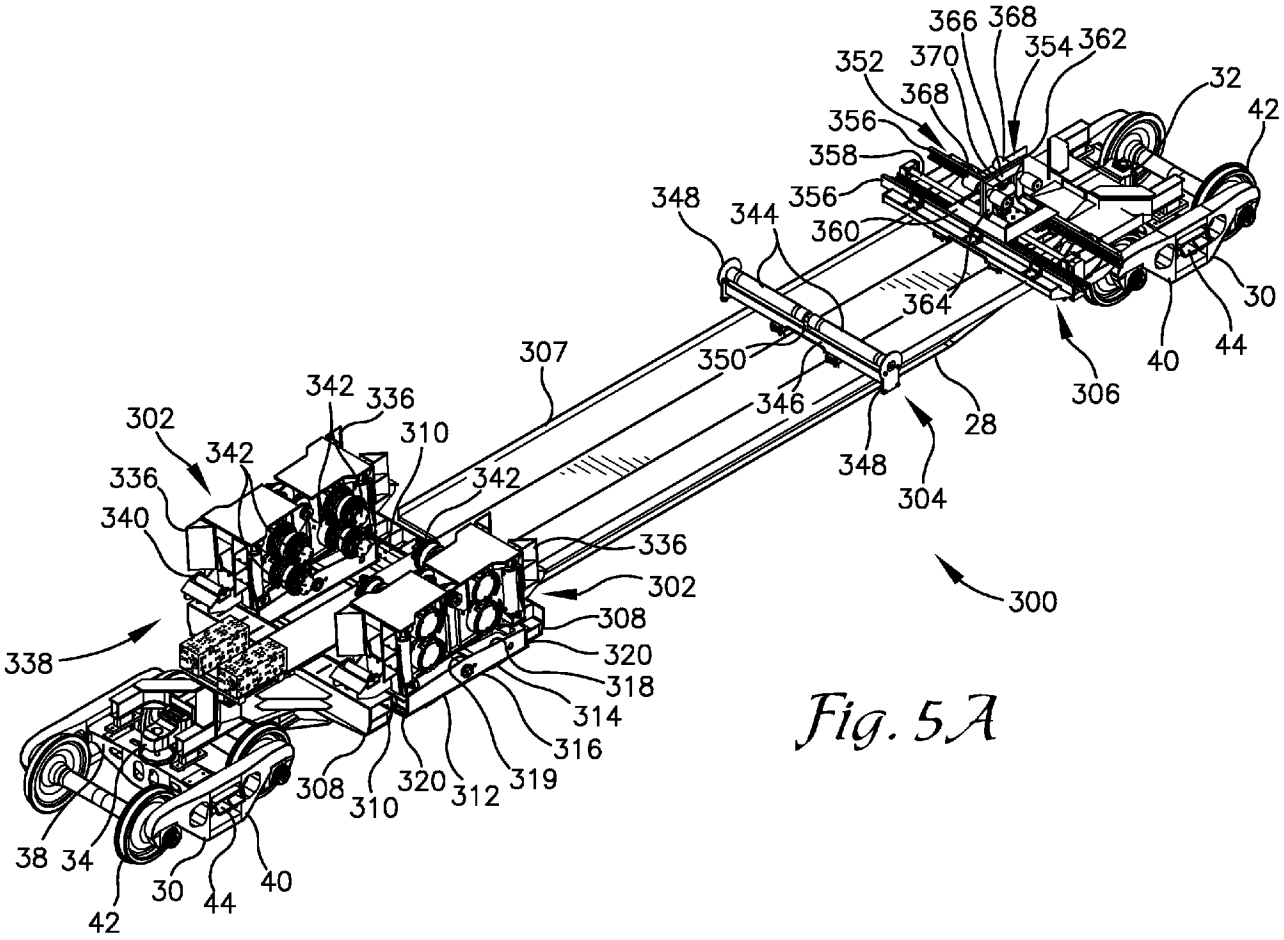
FIG. 5A is a perspective view of a crossover car depicted in accordance with an embodiment of the invention.

As depicted best by FIGS. 5A and E-G, the mounting assembly 312 comprises a generally rectangular housing 314 with a planar base 316 and a bifurcated top surface 318 that includes two planar sections that meet at a peak 319 near the midpoint of the length of the assembly 312. The top surface 318 includes a removed, generally rectangular, central portion within which a tilt table 321 is disposed.

The tilt table 321 includes a generally planar top surface with a pair of sidewalls 325 extending vertically downward from longitudinal edges thereof and a transverse wall 326 extending vertically downward along a forward edge. The tilt table 321 is pivotably coupled to the housing 314 via an axle 330 disposed through longitudinal sidewalls of the housing 314 and through the sidewalls 325 of the tilt table 321. A tilt actuator 324 is generally vertically disposed in the interior of the housing 314 of the mounting assembly 312. The tilt actuator 324 is coupled at a lower end to the base 316 of the mounting assembly 312. An upper end of the tilt actuator 324 couples to the forward, transverse wall 326 of the tilt table 321 to thereby enable pivoting of the tilt table 321 about a generally horizontal axis transverse to the body 28 formed by the axle 330. The tilt table 321 and tilt actuator 324 are configured to provide from about zero to about fifteen degrees of pivotal motion or more preferably between about zero and about eight degrees of pivotal motion about the axle 330.

The tilt table 321 also includes a cylindrical twist-mount 327 located centrally along the top surface of the tilt table 321 and extending vertically upward therefrom. The twist-mount 327 is configured to rotatably couple to the primary drive unit 302 to allow the drive unit 302 to rotate about a generally vertical axis extending through the twist-mount 327. The twist-mount 327 can fully support the drive unit 302 or the drive unit 302 can include one or more rollers, pads, bearing, or other components that slideably or rollingly contact the tilt table 321 to provide support for the drive unit 302 while also enabling the drive unit 302 to rotate with respect to the tilt table 321.

A rigid flange 329 extends from a rearward end of the tilt table 321 for coupling to a first end of a horizontally and transversely disposed twist actuator 331. A second end of the twist actuator 331 is coupled to a bracket 333 attached to the bottom surface of the drive unit 302. The twist actuator 331 is thus useable to rotate the drive unit 302 about the twist-mount 327. The twist actuator 331 provides between zero and fifteen degrees of rotation of the drive unit 302 about the twist-mount 327 or more preferably between about zero and about eight degrees of rotation.

A channel 320 is included at the forward and rearward ends of the mounting assembly 312. The channels 320 are configured to receive the support tracks 310 mounted on the support arms 308 and may include one or more bearings or bearing surfaces to aid sliding of the channels 320 along the support tracks 310. The support tracks 310 thereby also support the mounting assembly 312 and the drive unit 302 mounted thereon. In other embodiments, one or more tracks may be mounted on a top surface of the support arms 308 in addition to or instead of the support tracks 310 to provide additional support for the mounting assembly 312.

A pair of positioning actuators 322, such as hydraulic actuators, is disposed between the body 28 and the mounting assembly 312. The actuators 322 couple to the mounting assembly 312 along the base 316 with the actuators 322 spaced apart along the length of the base 316 and oriented generally transverse to the length of the base 316 and the body 28. The positioning actuators 322 are thus operable to slideably move the mounting assembly 312 and the drive unit 302 transversely inward toward the body 28 of the crossover car 300 and outward away from the body 28 by sliding the mounting assembly channels 320 along the support tracks 310. More or fewer positioning actuators 322 can be used; using two or more spaced apart positioning actuators 322 avoids twisting or uneven movement of the mounting assembly 312 along the support tracks 310. An inward position of the mounting assembly 312 and the drive unit 302 nearest to the body 28 provides a stowed position while an outward position, away from the body 28 might provide an operating position, however the drive unit 302 can be operated in any position. The mounting assembly 312 and drive unit 302 are moveable up to approximately twelve to eighteen inches away from the body 28, or more preferably up to about six and one half inches away from the body 28.

The positioning actuators 322, the tilt actuator 324, and the twist actuator 331 are each useable to orient and move the primary drive unit 302 and to direct the ribbon rail 22 along a desired path. The actuators 322, 324, and 331 can maintain a desired position and orientation of the drive unit 302 or the drive unit 302 can be enabled to float similarly to that described previously with respect to the guide box 260. Floating relaxes or relieves hydraulic pressure on one or more of the actuators 322, 324, and 331 to enable the drive unit 302 to be moved, pivoted, or turned by forces applied thereon via the ribbon rail 22, workers, or the rail lifting and manipulating apparatus 204. As such, the drive unit 302 can freely adjust its position and/or orientation to reduce binding and/or tension on the ribbon rail 22, the drive unit 302, and other associated components like the guide box 260 or the crossover guide assembly 306 discussed below.

The primary drive unit 302 is comprised of a lower housing 332, a forward and a rearward upper housing 335*a*, 335*b*, a forward upper 334*a* and lower 334*b* drive roller unit, and a rearward upper 334*c* and lower 334*d* drive roller unit. The forward and rearward lower drive roller units 334*b*, 334*d* are disposed in the lower housing 332 aligned transverse to the body 28 and spaced apart along the length of the lower housing 332. A pair of upright supports 337 extends vertically from opposite sides of the lower housing 332 and between the forward and rearward lower drive roller units 334*b*, 334*d*.

The forward upper housing 335*a* is configured to house the forward upper drive roller unit 334*a* in a position generally vertically above the forward lower drive roller unit 334*b*. The forward upper housing 335*a* is disposed on the lower housing 332 and positioned forward of the upright supports 337. The rearward upper housing 334*b* is similarly configured to house the rearward upper driver roller unit 334*c* in a position generally vertically above the rearward lower driver roller unit 334*d* and is disposed on the lower housing 332 rearward of the upright supports 337.

Figure 5C:
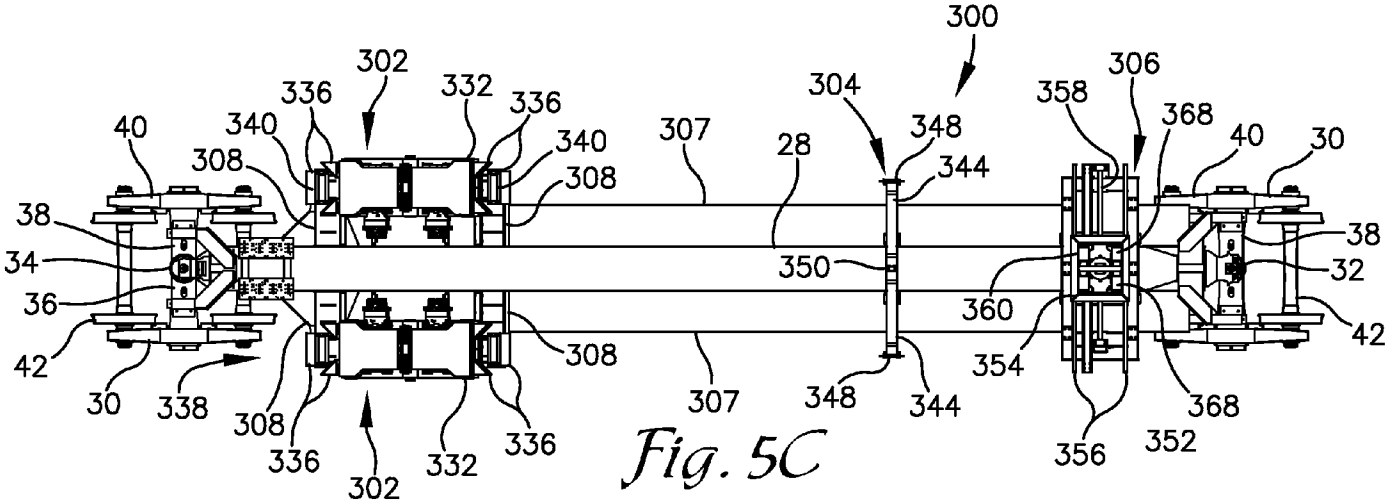
FIG. 5C is a top plan view of the crossover car of FIG. 5A.
Figure 5B:
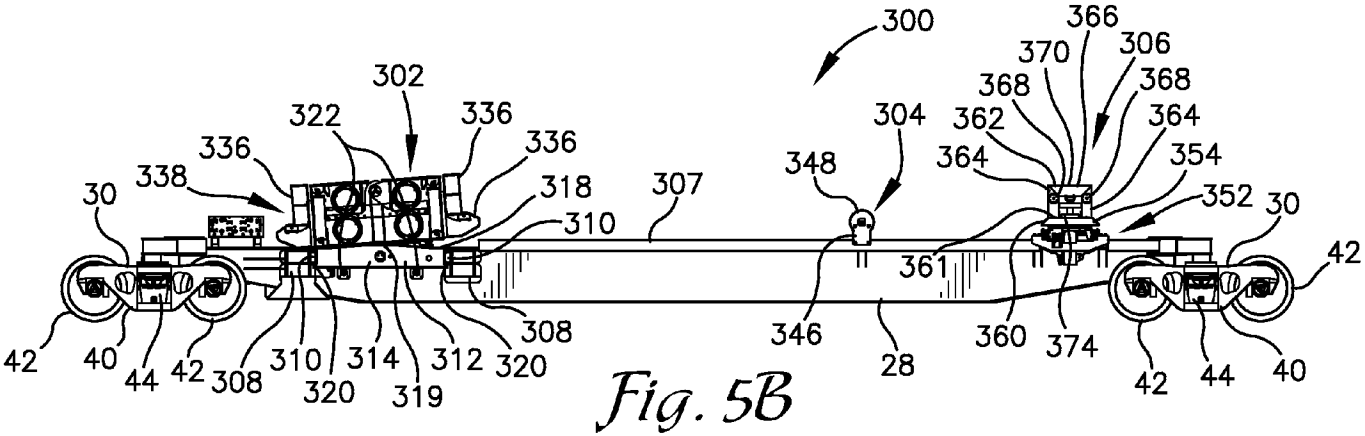
FIG. 5B is a side elevational view of the crossover car of FIG. 5A.
Figure 5D:
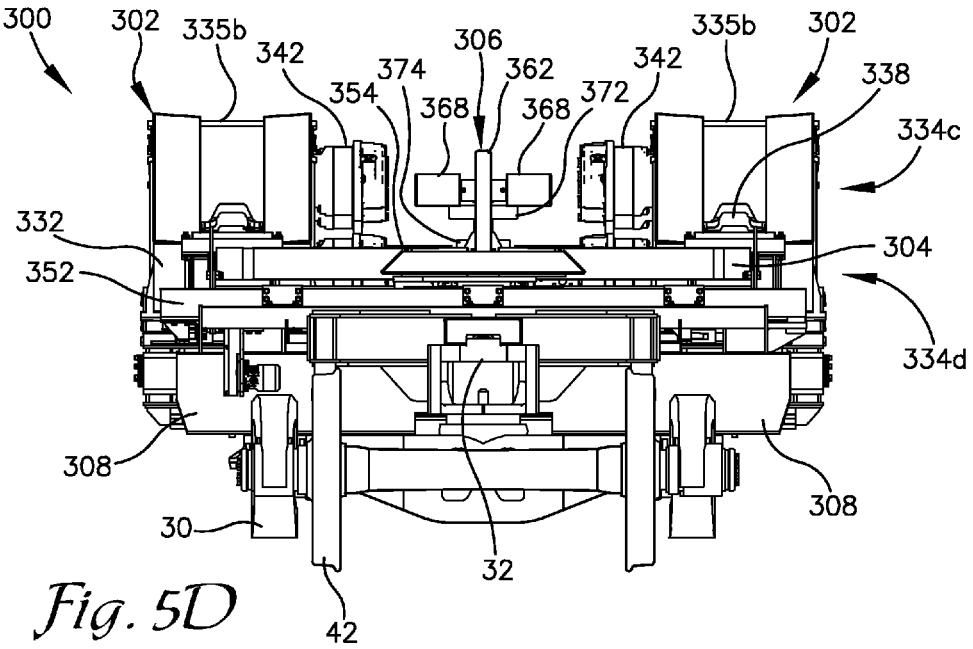
FIG. 5D is a rear end elevational view of the crossover car of FIG. 5A.
Figure 5E:
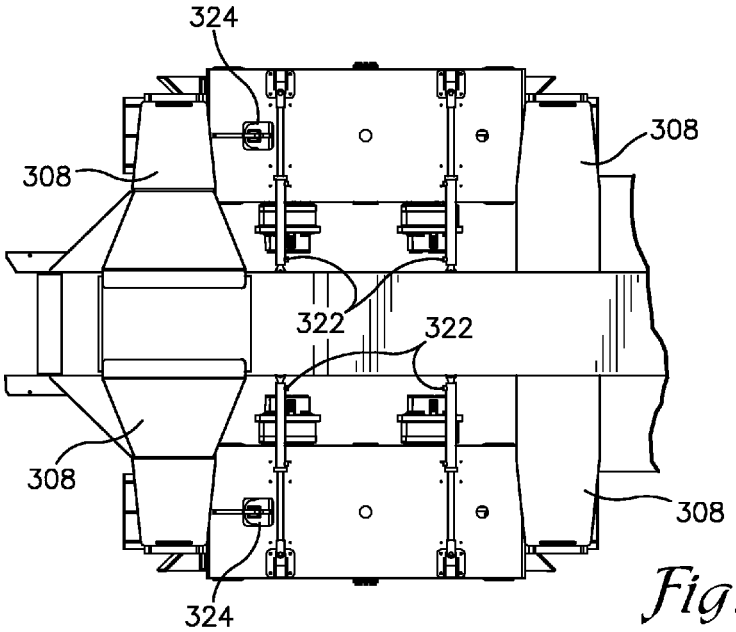
FIG. 5E is a bottom partial plan view of drive units mounted on the crossover car of FIG. 5A.
Figure 5F:
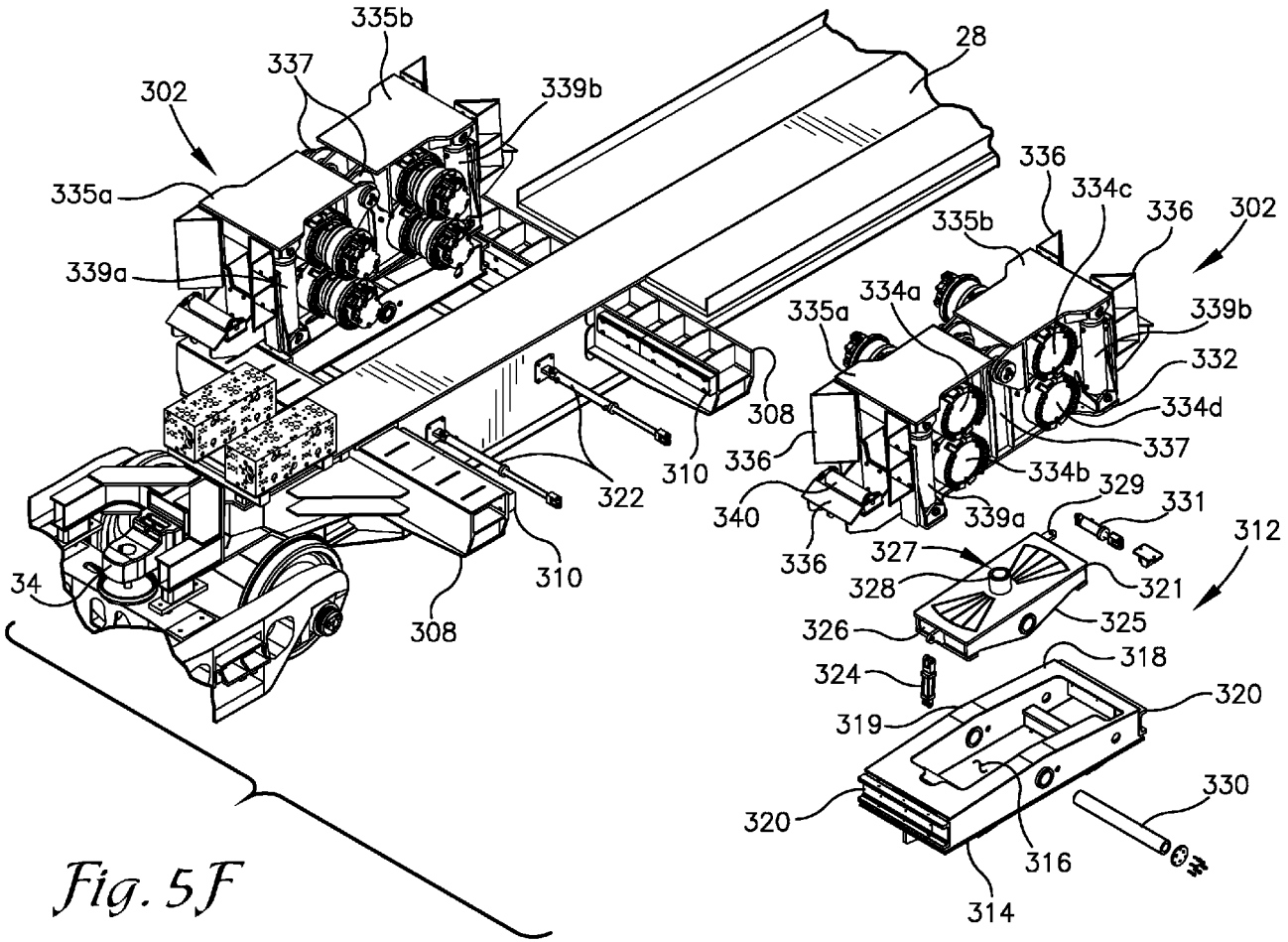
FIG. 5F is a partial exploded view of a drive unit of the crossover car of FIG. 5A.
Figure 5G:
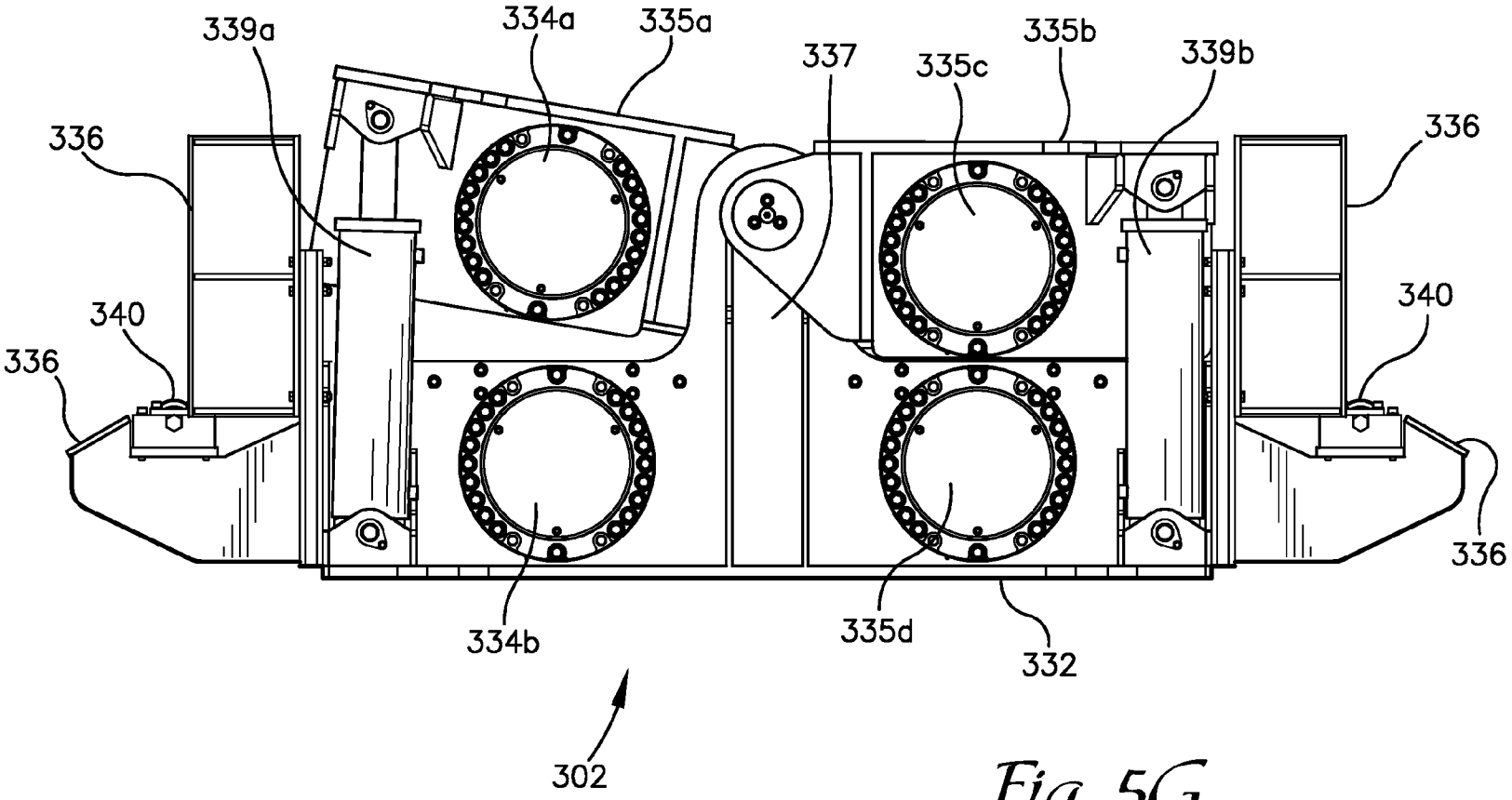
FIG. 5G is a side elevational view of the drive unit of FIG. 5F depicting an upper housing pivoted vertically upward away from a lower housing of the drive unit to allow a rail with debris thereon to pass through the drive unit in accordance with an embodiment of the invention.
Figure 5H:
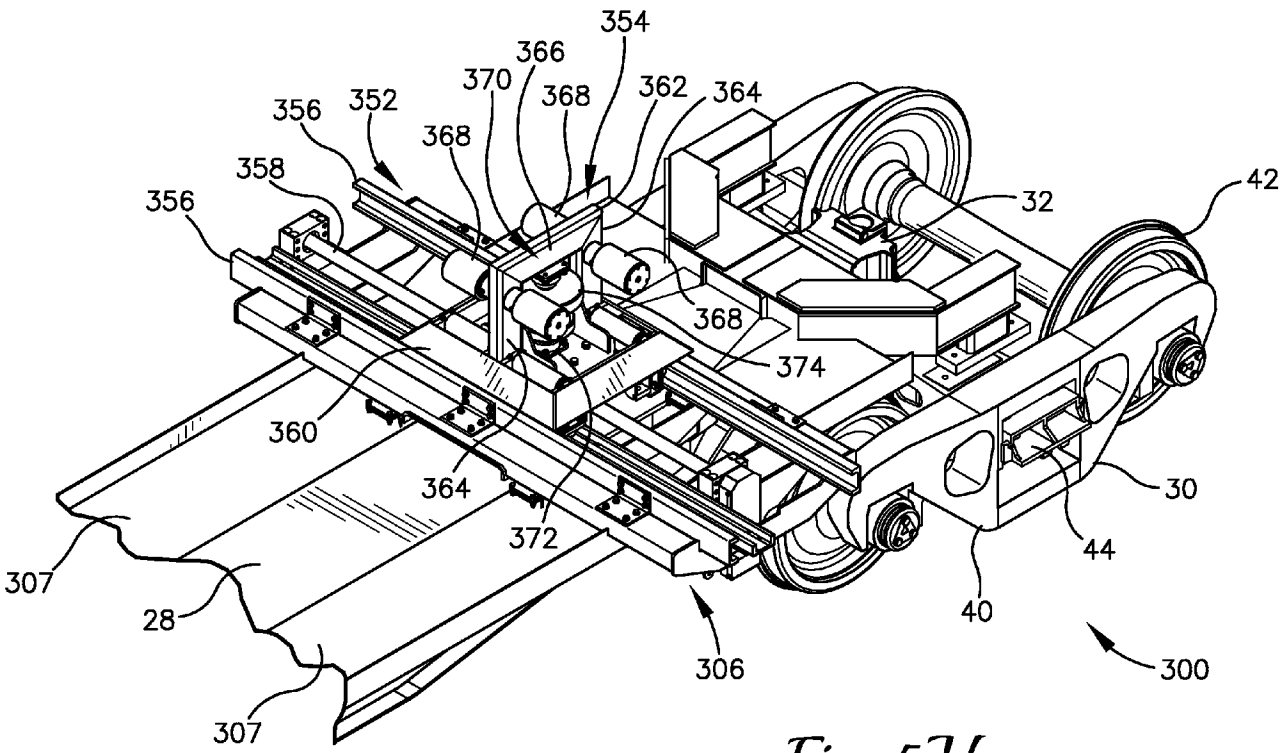
FIG. 5H is an enlarged perspective view of a crossover guide assembly of the crossover car of FIG. 5A.

As best depicted in FIG. 5G, the upper housings 335*a*, 335*b* are pivotally coupled about distal ends of the upright supports 337 to enable the upper housings 335*a*, 335*b* to pivot vertically upward about the distal ends of the upright supports 337. Vertically oriented actuators 339*a*, 339*b* are coupled between the lower housing 332 and each of the upper housings 335*a*, 335*b* generally at each corner of the primary drive unit 302. The actuators 339*a*, 339*b* are operable to pivot the forward and rearward upper housings 335*a*, 335*b*, respectively, about their coupling with the upright supports 337 to thereby pivot the upper drive roller units 334*a*, 334*c* disposed therein vertically upward and away from the lower driver roller units 334*b* and 334*d* respectively. As such, the upper drive roller units 334*a*, 334*c* are vertically displaceable to enable ribbon rail 22 with debris or an upset weld attached thereto to pass through the drive unit 302.

The actuators 339*a* coupled to the forward upper housing 335*a* are independently operable from the actuators 339*b* coupled to the rearward upper housing 335*b*. This configuration allows the forward upper housing 335*a* to be pivoted to allow debris on the rail 22 to pass between the forward drive roller units 334*a* and 334*b* while the rearward drive roller units 334*c* and 334*d* remain in contact with the rail 22 to drive the rail 22 through the drive unit 302. Upon passing the forward drive roller units 334*a*, 334*b* the forward upper housing 335*a* can be lowered to again drive the rail 22 and the rearward upper housing 335*b* can be pivoted upwardly to allow the debris to pass. After the debris has passed through the drive unit 302 the rearward upper housing 335*b* is lowered to again enable the rearward drive roller units 334*c* and 334*d* to drive the rail 22. The process can be reversed to allow debris to pass through the drive unit 302 in the opposite direction. The operation of the actuators 339*a*, 339*b* is performed manually by a worker operating the machine 10 or can be configured for automatic operation.

Pivoting of the upper housings 335*a* and 335*b* also enables ribbon rails 22 of varied heights to be accepted in the drive channel 338 by adjusting the spacing between the rollers of the drive roller units 334*a-d* accordingly. The actuators 339*a*, 339*b* are also operable to adjust an amount of pressure applied by the drive roller units 334*a-d* on the ribbon rail 22 to, for example, increase or decrease an amount of friction between the rollers of the drive roller units 334*a-d* and the ribbon rail 22. The actuators 339*a*, 339*b*, in combination with an accumulator (not shown) can further provide a shock-absorbing feature to enable the top and bottom drive roller units 334*a-d* to momentarily vertically separate when an obstruction is encountered. The shock-absorbing feature allows the top and bottom drive roller units 334*a-d* to further separate to allow the ribbon rail 22 and debris to pass therebetween.

The lower housing 332 also includes guide flanges 336 mounted on forward and rearward faces of the lower housing 332 to direct an end of the ribbon rail 22 into a drive channel 338 of the drive unit 302. One or more guide rollers 340 can also be provided in association with the guide flanges 336 to assist movement of the ribbon rail 22 into and through the drive channel 338.

The drive roller units 334*a-d* include rollers that extend transversely across the top and bottom of a drive channel 338, thereby defining the drive channel 338 through which the ribbon rail 22 can pass through the drive unit 302. At least one of the drive roller units 334*a-d* is driven or powered by a hydraulic, electric, or other motor 342 to draw the ribbon rail 22 through the drive channel 338; the remaining drive roller units 334*a-d* can be freely rotatable. As depicted in FIGS. 5A-C, four powered drive roller units 334*a-d* are provided and can generate pulling or driving forces on the ribbon rail 22 of greater than 120,000 pounds of force.

The rollers of the drive roller units 334*a-d* may have a profile configured to compliment the head 46 and/or foot 50 of the ribbon rail 22. For example, the rollers of the lower drive roller units 334*b* and 334*d* may have a flat profile to compliment the flat bottom flange or foot 50 of the ribbon rail 22 while top drive roller units 334*a* and 334*c* include a recessed central portion configured to receive the head 46 of the ribbon rail 22. Providing a complimentary profile on one or both of the rollers of the drive roller units 334 may aid to maintain the ribbon rail 22 in an upright orientation and to direct the ribbon rail 22 in a desired direction.

With continued reference to FIGS. 5A-C, the support roller assembly 304 is disposed on top of the crossover car 300 between the primary drive units 302 and the crossover guide assembly 306. The support roller assembly 304 is spaced less than thirty feet from both the drive unit 302 and the crossover guide assembly 306 which may be spaced greater than thirty feet apart. The support roller assembly 304 thus provides support to the ribbon rail 22 against sagging or bowing between the drive unit 302 and the crossover guide assembly 306 or a subsequent component. As described previously, it is generally understood in the art that an unwanted amount of sagging or bowing of the ribbon rail 22 tends to occur over spans of about thirty feet or greater.

The support roller assembly 304 comprises a pair of elongate support rollers 344 mounted end-to-end on an elongate base 346. The base 346 is coupled to the body 28 of the crossover car 300 and extends transversely thereto. It is foreseen that the support roller assembly 304 can be adjustably mounted for selective movement along the length of the body 28.

Flanges 348 extend vertically upward from opposite ends of the base 346 and provide rotatable coupling with the support rollers 344. The flanges 348 are dimensioned to extend a distance beyond the diameter of the support rollers 344 to obstruct a section of ribbon rail 22 riding across the support rollers 344 from moving past or off of the distal ends of the support rollers 344. A central flange 350 extends vertically upward from a central location along the length of the base 346 and rotatably couples to proximate ends of both support rollers 344.

The crossover guide assembly 306 is mounted on the body 28 of the crossover car 300 near a rear end thereof as best depicted in FIGS. 5A-C and H. The crossover guide assembly 306 comprises a rail assembly 352 oriented transverse to the body 28 and a guide carrier 354 slideably disposed thereon. The rail assembly 352 includes a plurality of rails or tracks 356 and a threaded rod 358 that extend transverse to the body 28 of the crossover car 300. The threaded rod 358 is rotatable about its length via an electric or hydraulic motor or a hand operated crank (not shown). The guide carrier 354 includes a base 360 configured to engage and be slideably moveable along the tracks 356. The base 360 also threadably couples to the rod 358 such that rotation of the rod 358 causes the guide carrier 354 to move left or right along the tracks 356 and across the width of the crossover car 300. It is foreseen that in other embodiments the threaded rod 358 could be replaced with one or more hydraulic or pneumatic actuators or other device useable to translate the guide carrier 354 along the tracks 356. One or more horizontal rollers or sliding surfaces can be included in a top surface 361 of the base 360 and extending parallel to the rail assembly 352 to aid movement of the ribbon rail 22 thereacross.

A generally planar vertical stand 362 extends vertically upward along the midline of the top surface of the base 360 and is aligned in a plane substantially parallel to the body 28 of the crossover car 300. The vertical stand 362 comprises a pair of spaced apart vertical arms 364 with a cross member 366 joining their upper ends. Each of the vertical arms 364 has a pair of horizontal guide rollers 368 mounted thereon proximate its upper end and extending laterally outward from opposite sides thereof.

A vertical member 370 is rotatably coupled between the midpoint of the cross member 366 and the base 360. The vertical member 370 includes lower and upper radially extending circular flanges 372 and 374. The lower circular flange 372 has a diameter that is less than that of the upper circular flange 374. The lower circular flange 372 is disposed on the vertical member 370 near the top surface 361 of the base 360 and slightly spaced apart therefrom to avoid contact between the lower circular flange 372 and the base 360. The upper circular flange 374 is disposed on the vertical member 370 spaced a distance vertically above the lower member 372 and below the height of the horizontal guide rollers 368 on the arms 364 of the stand 362. The vertical spacing between the lower and upper circular flanges 372, 374 corresponds to the height of the ribbon rail 22.

As such, the lower and upper circular flanges 372, 374 are configured to abut the lower and upper flanges of the ribbon rail 22, respectively, as the rail 22 passes alongside the crossover guide assembly 306, e.g. the difference between the diameters of the upper and lower circular flanges 372, 374 corresponds to the difference in the widths of the head 46 and the foot 50 of the ribbon rail 22. The diameters of the upper and lower circular flanges 372, 374 and the vertical spacing therebetween can be adjusted or changed to accommodate various sizes and shapes of ribbon rail 22. The vertical position of the ribbon rail 22 is also guided or maintained from below by the top surface 361 of the base 360 and from above by the horizontal guide rollers 368 which extend over the head 46 of the rail 22.

The crossover guide assembly 306 can thus guide or move the ribbon rail 22 from side-to-side across the crossover car 300 by moving the guide carrier 354 toward the ribbon rail 22, engaging the ribbon rail 22 between the horizontal guide rollers 368 and the base 360, and contacting the head 46 and foot 50 of the ribbon rail 22 with the upper and lower circular flanges 374, 372, respectively. Once engaged, the ribbon rail 22 can be pushed or guided transverse to its length as needed to steer the ribbon rail 22 toward downstream components as described in greater detail below.

Processing Car

Figure 6A:
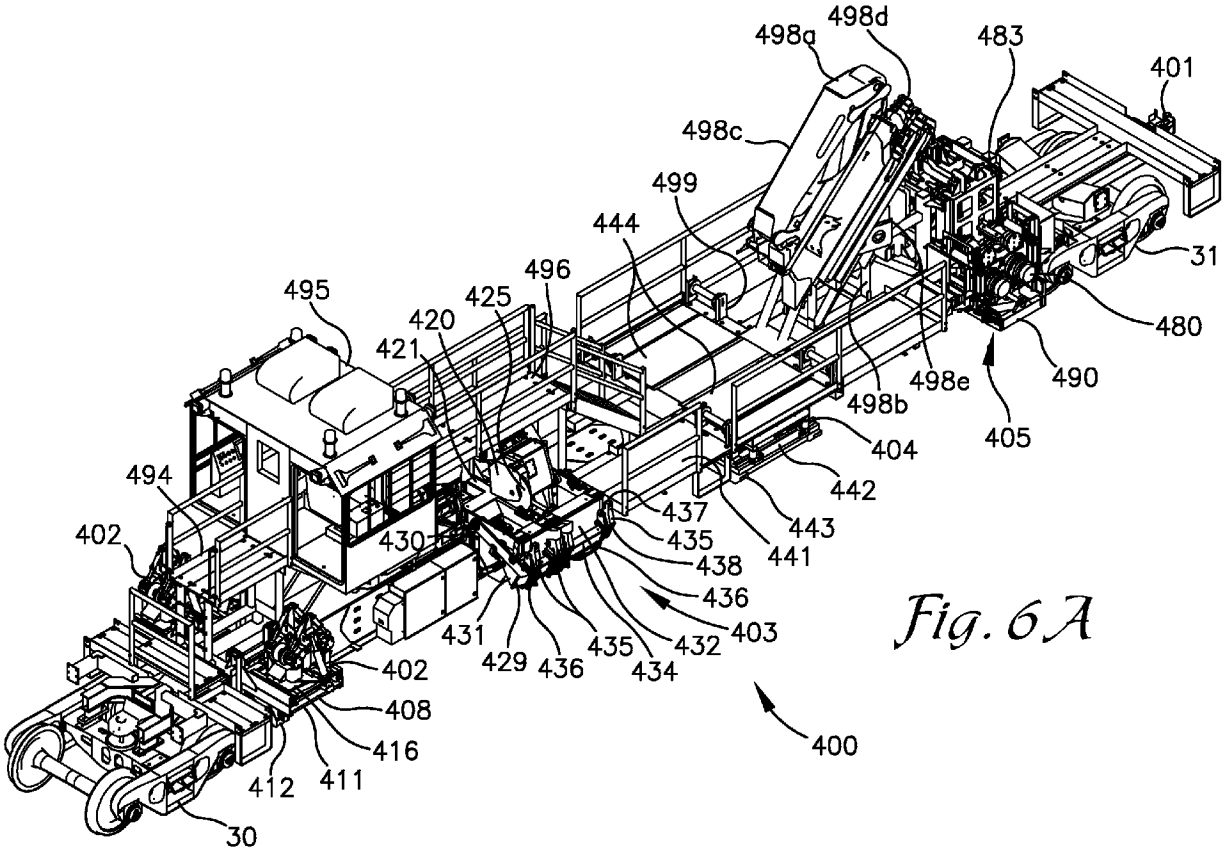
FIG. 6A is a perspective view of a processing car depicted in accordance with an embodiment of the invention.
Figure 6C:
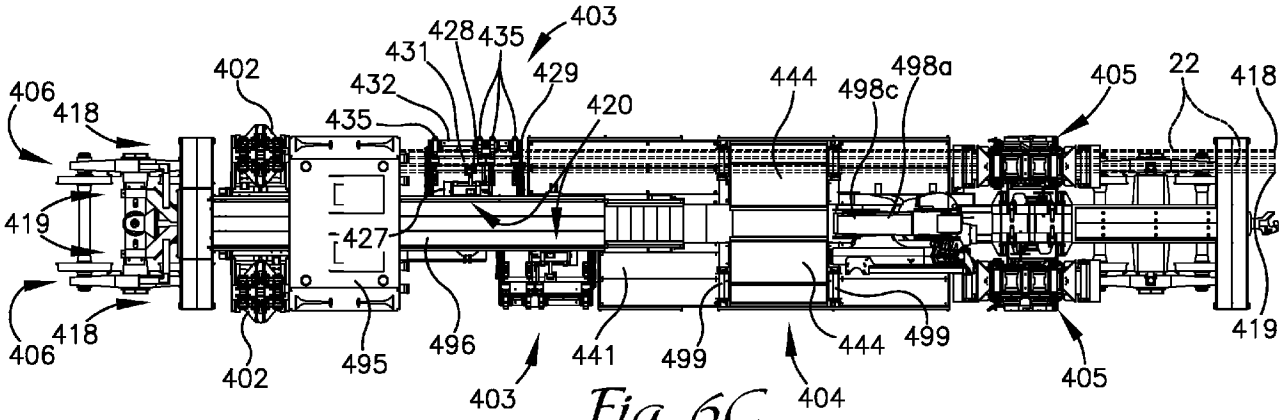
FIG. 6C is a top plan view of the processing car of FIG. 6A.

Referring to FIGS. 6A-6D, the processing car 400 is coupled behind the crossover car 300 via a shared truck 30. The processing car 400 includes the shared truck 30 at a front end of a body 28 with a dedicated truck 31 and a coupler 401 at a rear end for coupling to subsequent rail cars, such as the rail transport train 12, located at a rear end of the car 400. Moving from the front of the processing car 400 toward the rear, each side of the processing car 400 includes a guide box 402, a cutting station 403, a drill station 404, and a secondary drive unit 405 disposed along the respective side and positioned generally across the body 28 or slightly offset from one another. As such, the processing car 400 provides two separate parallel processing paths 406 (as indicated in FIG. 6C by arrows 406) that can be followed by the ribbon rail 22 as the ribbon rail 22 traverses the processing car 400—one path 406 along each side of the body 28. The components 402, 403, 404, 405 along each path 406 are similarly configured and thus only the components 402, 403, 404, 405 along one of the paths 406 are described below so as not to obscure the description. It is to be understood that the components 402, 403, 404, 405 and others described herein, might be provided singly and can be positioned differently or omitted from the processing car 400 or machine 10 without departing from the scope of embodiments of the invention described herein.

The guide box 402 is configured similarly to the guide box 260 disposed on the pick-up car 200. As such, the guide box 402 is not described in detail here. However, the guide box 402 employs a different mounting on the body 28 of the processing car 400 than that used for the guide box 260 on the pick-up car 200. It is to be understood, however, that the guide box 402 could be mounted on the processing car 400 using the same or similar pivotable support arm as described above with respect to the guide box 260, e.g. the support arm 262.

Figure 6B:
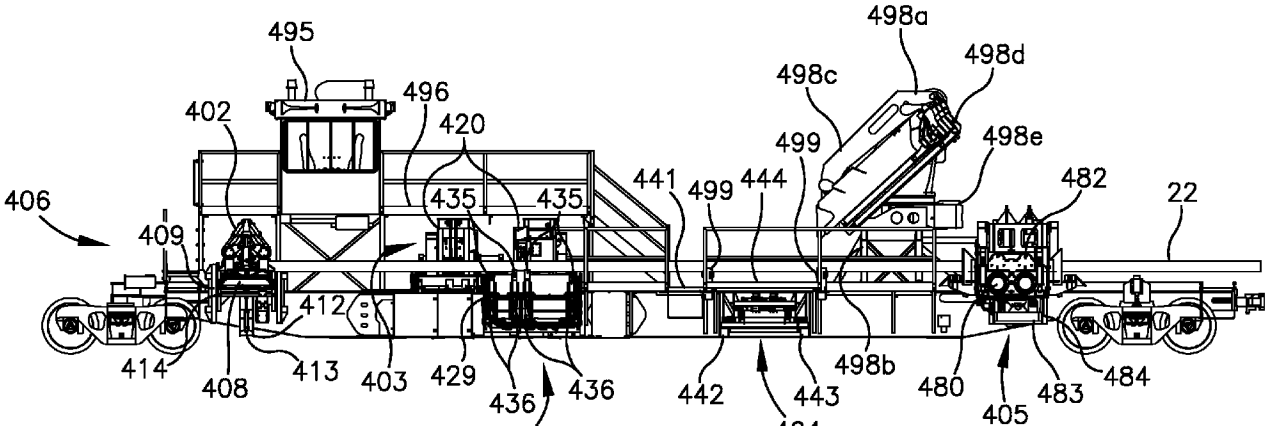
FIG. 6B is a side elevational view of the processing car of FIG. 6A.
Figure 6D:
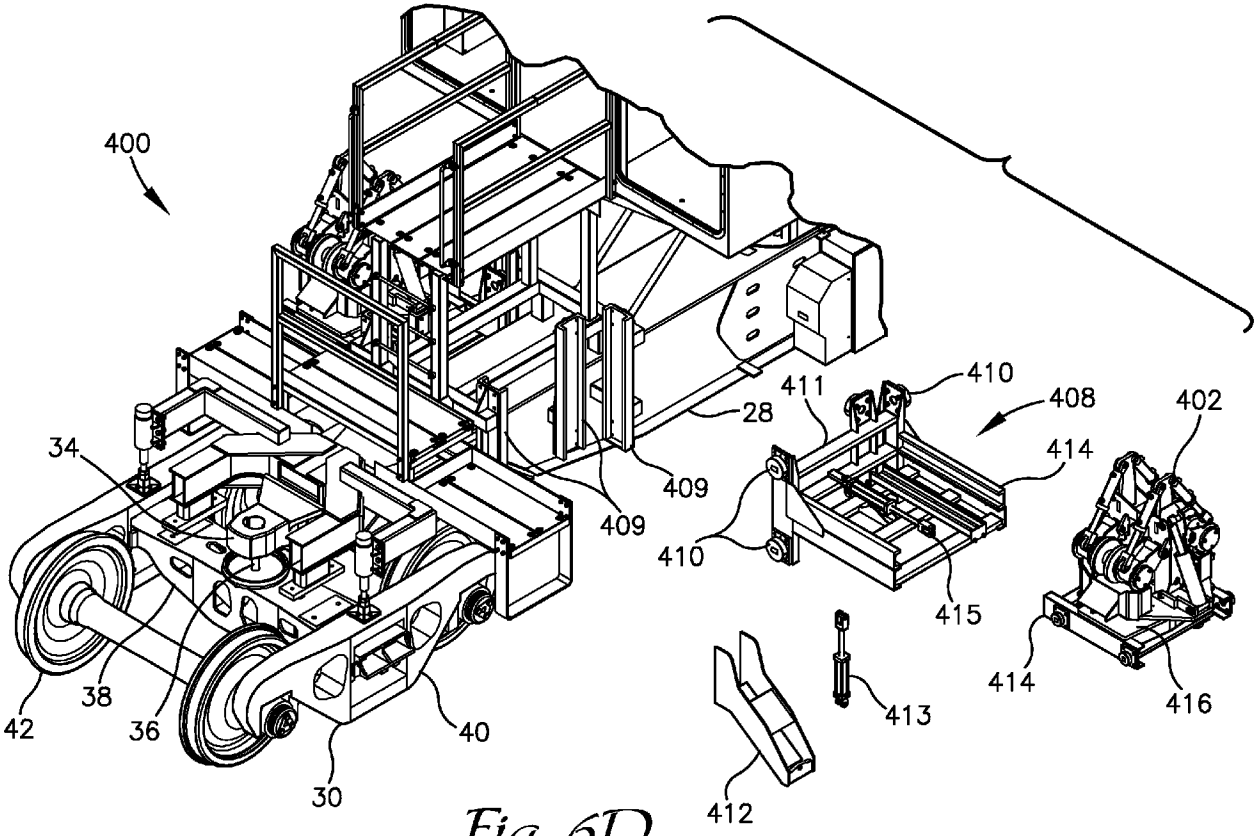
FIG. 6D is a partial exploded view of a mounting assembly for a guide box on the processing car of FIG. 6A.

As shown in FIGS. 6A-C, the guide box 402 is mounted on a carriage 408 that is coupled to the body 28 of the processing car 400 by a pair of vertically disposed tracks 409 or C-shaped channels attached to the side of the body 28 with the open faces of the C shape facing toward one another. Mating bearing assemblies 410 including, for example, a plurality of wheel bearings mounted on support members, are provided on a forward and a rearward side of a frame 411 of the carriage 408 and engage the tracks 409. A support arm 412 is provided extending from the side of the body 28 below the carriage 408 and is supportably coupled to the carriage 408 by a vertically oriented hydraulic actuator 413 disposed between a distal end of the support arm 412 and the bottom of the carriage 408. The carriage 408 is thus vertically moveable along the tracks 409 by actuation of the actuator 413 to move the guide box 402 up or down with respect to the processing car 400.

The frame 411 of the carriage 408 further includes a horizontal track assembly 414 and an associated horizontally disposed hydraulic actuator 415 that enables horizontal movement of the guide box 402 transversely toward and away from the body 28 of the processing car 400.

A mounting plate 416 is disposed on the carriage 408 and couples the guide box 402 to the carriage 408. The mounting plate 416 may be rotatably coupled to the frame 411 to enable rotation of the mounting plate 416 about a vertical axis through the plate 416 and carriage 408. A twist actuator (not shown) can be operatively coupled between the frame 411 of the carriage 408 and the mounting plate 416 to enable rotation of the mounting plate 416 via operation of the twist actuator.

Using the carriage 408, the guide box 402 is moveable both upward and downward, inward and outward from the body 28, and is rotatable or pivotable about a vertical axis to direct the ribbon rail 22 along the path 406 as desired. The guide box 402 can thus be employed to direct the ribbon rail 22 along one of two operational routes: a bypass route 418 or a cutting route 419 as indicated by phantom lines in FIG. 6C. As shown in the drawings, the bypass route 418 is located outboard or further away from the body 28 than the cutting route 419. However, it is to be understood that the routes 418, 419 can be otherwise positioned and/or combined into a single route as desired without departing from the scope of embodiments of the invention described herein.

Figure 6E:
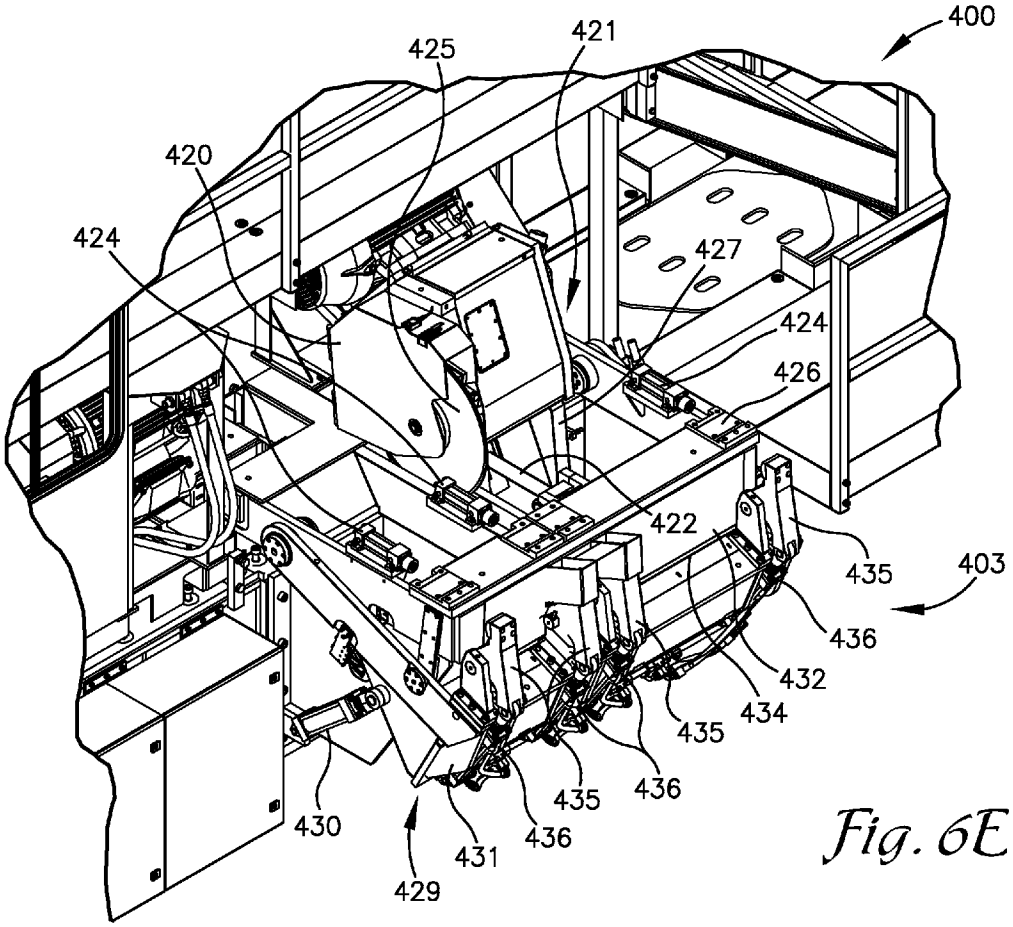
FIG. 6E is an enlarged partial perspective view of a cutting station of the processing car of FIG. 6A.
Figure 6F:
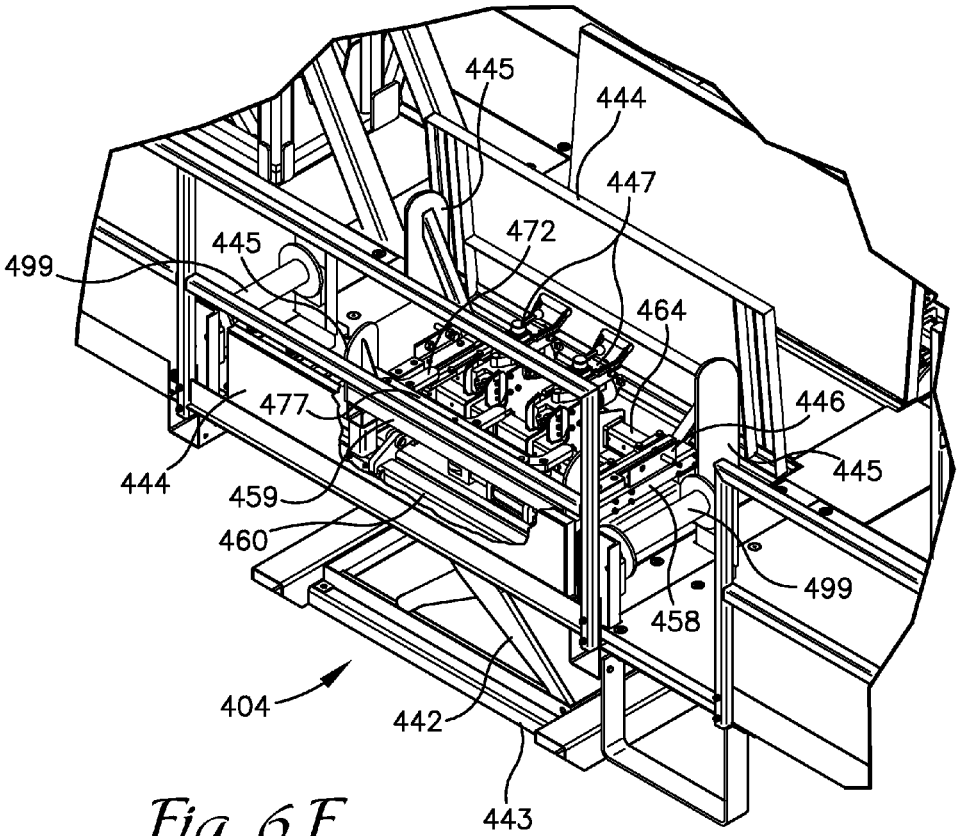
FIG. 6F is an enlarged partial perspective view of the processing car of FIG. 6A depicting a drill station in a raised position in accordance with an embodiment of the invention.

The cutting station 403 houses a saw 420 configured to cut or section the ribbon rail 22 transversely to its length. As depicted best in FIG. 6E, the saw 420 is disposed in a fixture 421 that clamps the ribbon rail 22 while the saw 420 is moved toward and transversely to the length of the rail 22 to cut the rail 22. The fixture 421 is coupled to the body 28 of the processing car 400 and provides a mounting location for the saw 420. The fixture 421 provides one or more support members 426 that support the ribbon rail 22 from below when in the cutting and/or bypass routes 419, 418.

The saw 420 is disposed on a swing arm 427 pivotably coupled to the fixture 421 near the lower edge of the fixture 421. The swing arm 427 is generally vertically disposed with the lower end thereof pivotally coupled to the fixture 421 and the upper end coupled to the saw 420. A hydraulic actuator 422 is disposed between the upper end of the swing arm 420 and the fixture 421 and is actuatable to pivot the swing arm 427 and the saw 420 about the lower end of the swing arm 427 to move the saw 420 outwardly away from the body 28 and toward a ribbon rail 22 disposed in the cutting station 403. The stroke of the movement of the saw 420 on the swing arm 427 is sufficient to reach and cut through the rail 22 in the cutting route 419 but may not be sufficient to reach the rail 22 when the rail 22 is in the bypass route 418. In another embodiment, the saw 420 is mounted on a carriage that is slideably coupled to the fixture 421 to translate the saw 420 horizontally outward from the body 28 toward the ribbon rail 22.

Three hydraulic rams 424 are mounted on the fixture 421 and extend horizontally outward away from the body 28. Two of the rams 424 are located forward of a blade 425 of the saw 420 while the third ram 424 is located rearward of the blade 425 and at a rear end of the fixture 421. The rams 424, when actuated extend to contact the foot 50 of a ribbon rail 22 disposed on the support members 426 and to press and hold the rail 22 against a vertically extending flange (not shown) along an opposite side of the support members 426.

The saw 420 is any saw available in the art that is suitable to cut the ribbon rail 22. For example, the saw 420 might be a model AMR-S200L from the Advanced Machine and Engineering Company of Rockford, Ill. The saw 420 may employ a carbide-tipped blade 425 that provides sparkless or substantially sparkless cutting of the ribbon rail 22 without coolants, lubricants, or other fluids being applied to the blade 425 or the rail 22. Such is beneficial in dry environments that are susceptible to fire that might result from sparks leaving the cutting station 403. The saw 420 can be configured as a chop saw, band saw, torch, or other form of cutting apparatus with or without the use of coolants or lubricants. For example, the saw 420 can be configured as a chop saw that pivots about an axis transverse to the blade 425 to move the blade 425 downward toward and through the ribbon rail 22.

A clamping assembly 429 hingedly couples to forward and rearward most ends of the fixture 421. Actuators 430 extend between the clamping assembly 429 and the fixture 421 or the body 28 to pivot the clamping assembly 429 between a lowered position (FIGS. 6A and 6E) and a raised or clamping position (FIG. 6C). The clamping assembly 429 may not be configured to clamp the rail 22 in the bypass route 418. The clamping assembly 429 includes a horizontally concave panel or backstop 431 extending the length of the fixture 421 and configured to deflect metal filings and/or sparks produced by cutting the ribbon rail 22 toward the ground near or under the processing car 400. The backstop 431 can alternatively comprise a trough configured to catch and collect the metal filings and/or sparks produced by the saw 420. A guard panel 432 is fixedly attached along an upper outboard edge 434 of the backstop 431.

Four clamps 435 are pivotally coupled along the outboard edge 434 of the backstop 431. Each of the clamps 435 is pivotally coupled to the clamping assembly 429 along a central portion of the length of the clamp 435 to enable pivoting of the clamps 435 about an axis extending parallel to the backstop 431. The clamps 435 are positioned along the length of the backstop 431 with one clamp 435 at the forward-most and rearward-most ends of the backstop 431 and one clamp 435 positioned adjacent to each side of the blade 425 of the saw 420. Pivot actuators 436 are mounted on the exterior of the backstop 431 and coupled to lower ends of each of the clamps 435 to pivot the clamps 435 about their pivotal couplings. Upper ends of the clamps 435 may have a profile that compliments at least a portion of the head 46 of the ribbon rail 22 to contact the head 46 along the top and/or side thereof. The guard panel 432 may include one or more cutouts to allow at least the upper ends of the clamps 435 to pass through to the ribbon rail 22. As such, the pivot actuators 436 can be operated to pivot the clamps 435 about their pivotal couplings to place their upper ends into contact with the head 46 of a ribbon rail 22 disposed on the support members 426 to thereby hold the rail 22 downwardly against the support members 426.

The drill station 404 is mounted below a walkway 441 or main level of the processing car 400 on a retractable lift table 442. The lift table 442 is mounted on a support platform 443 extending from the side of the body 28. The lift table 442 comprises a scissor lift or similar assembly useable to raise the drill station 404 vertically from a retracted position (FIGS. 6A-C) below the walkway 441 to an operational position (FIG. 6D) above the walkway 441. In the operational position, the drill station 404 may contact and support at least the foot 50 of the ribbon rail 22 from below.

One or more cover panels 444 are hingedly disposed over the drill station 404 and form part of the walkway 441 when the drill station 404 is in the retracted position. Respective pairs of ears 445 extend vertically upward from the lift table 442 and from a drill carriage 446 mounted on the lift table 442. At least one pair of the ears 445 is positioned proximate to the hinged sides of each of the cover panels 444. Distal ends of the ears 445 are rounded or curved to form a cam surface that contacts the undersides of the cover panels 444 when the lift table 442 is raised to thereby pivot the cover panels 444 upwardly about their hinged sides and allow the lift table 442 to assume the operational position. The cover panels 444 might also be configured as a single or multiple panels. The cover panels 444 are also configured to enable pivoting about their hinged sides without contacting a ribbon rail 22 positioned thereabove.

The drill carriage 446 is mounted on the lift table 442 and provides mounting locations for two or more drill units 447, clamping of the ribbon rail 22 for drilling, and adjustability of the longitudinal position of the drill units 447 along the length of the rail 22. Referring to FIGS. 7A-7E, the drill carriage 446 comprises a pair of spaced apart tracks 448 extending longitudinally or parallel to the body 28 and fixedly coupled to the lift table 442. A lower frame 449 includes downwardly extending legs 450 with bearing assemblies 452 disposed on lower or distal ends thereof. The bearing assemblies 452 are received by the tracks 448 to slideably couple the lower frame 449 to the tracks 448 and to enable movement of the lower frame 449 parallel to the body 28 or forward and rearward along the drill station 404. A hydraulic actuator 453 is disposed between a cross member 454 extending between the tracks 448 and a parallel cross member 455 extending between a pair of the legs 450 on the lower frame 449 to control or provide the forward or rearward movement of the lower frame 449 on the tracks 448.

A forward member 456 extends horizontally between the upper ends of the forward most legs 450 and a rearward member 458 extends between the upper ends of the rearward most legs 450 and parallel to the forward member 456. A clamp support member 459 extends longitudinally between the upper ends of the outboard legs 450, e.g. between the outboard forward and rearward legs 450. The lower ends of the outboard legs 450 are joined by an outboard bar 460 extending longitudinally therebetween. The lower ends of the inboard legs 450 are similarly joined by an inboard bar 461 disposed therebetween.

An upper frame 462 includes a pair of parallel drill support members 464 extending longitudinally parallel to the body 28. The drill support members 464 are joined together by a pair of tracks or channel members 465, one of which is coupled across their forward ends and the other of which is coupled across their rearward ends. The tracks 465 are received on bearings 466 disposed on opposing faces of the forward and rearward members 456 and 458 of the lower frame 449 to slideably couple the upper frame 462 with the lower frame 449. A pair of positioning actuators 467 is coupled between the upper frame 462 and the outboard bar 460 of the lower frame 449 to provide movement of the upper frame 462 along the bearings 466 and transverse to the body 28 and the ribbon rail 22.

The two or more drill units 447 are each transversely to the drill support members 464 via one or more mounting brackets 468 (two shown for each drill unit 447). The drill units 447 are directed toward the clamp support member 459 of the lower frame 449. The mounting location of the drill units 447 can be adjustable along the length of the drill support members 464 to enable the spacing between the drill units 447 to be selected or adjusted as needed. The drill units 447 can thus be mounted at a desired spacing that corresponds with spacing between mounting holes in joint bars to be used to join two segments of ribbon rail 22. As such, holes can be simultaneously drilled in the sections of ribbon rail 22 and the joint bars installed without risk of the holes being misaligned or improperly located.

As depicted in FIGS. 7A-E, two drill units 447 are employed however, four or more drill units 447 might be used. The drill units 447 comprise manually activated drills that, when activated, provide an automatic drilling operation that causes a drill bit 470 or other fixture to be extended outwardly from the drill units 447 a distance and then automatically retracted upon completion of the drilling operation. The drill units 447 might also be automatically or remotely activated and can comprise any drill unit available in the art suitable for drilling through the ribbon rail 22, such as for example a hydraulic rail drill model RD12 from Stanley Hydraulic Tools of Milwaukie, Oreg.

The drill units 447 and/or the mounting brackets 468 include a guide or abutment 471 mounted thereon and extending toward the clamp support member 459 or toward the ribbon rail 22 disposed in the drill station 404. The abutments 471 are configured to contact and stabilize the side of the ribbon rail 22 during drilling. The abutments 471 may have a profile resembling that of the web 48 and/or portions of the head 46 or foot 50 of the ribbon rail 22 to provide a positive engagement with the ribbon rail 22.

With continued reference to FIGS. 7A-E, a plurality of clamp stops 472 are rotatably coupled to the clamp support member 459 and spaced along the length thereof. The clamp stops 472 comprise elongate, generally planar members having a first portion 473 thereof extending at an angle to a second portion 474. A pin 476 extends vertically through each clamp stop 472 generally at the intersection between the first and second portions 473, 474 and through the clamp support member 459 to rotatably couple the clamp stop 472 to the clamp support member 459. A connector bar 477 is rotatably coupled to a distal end of each of the second portions 474 of the clamp stops 472 such that their rotational movements are linked and are the same from one clamp stop 472 to another.

Figure 7A:
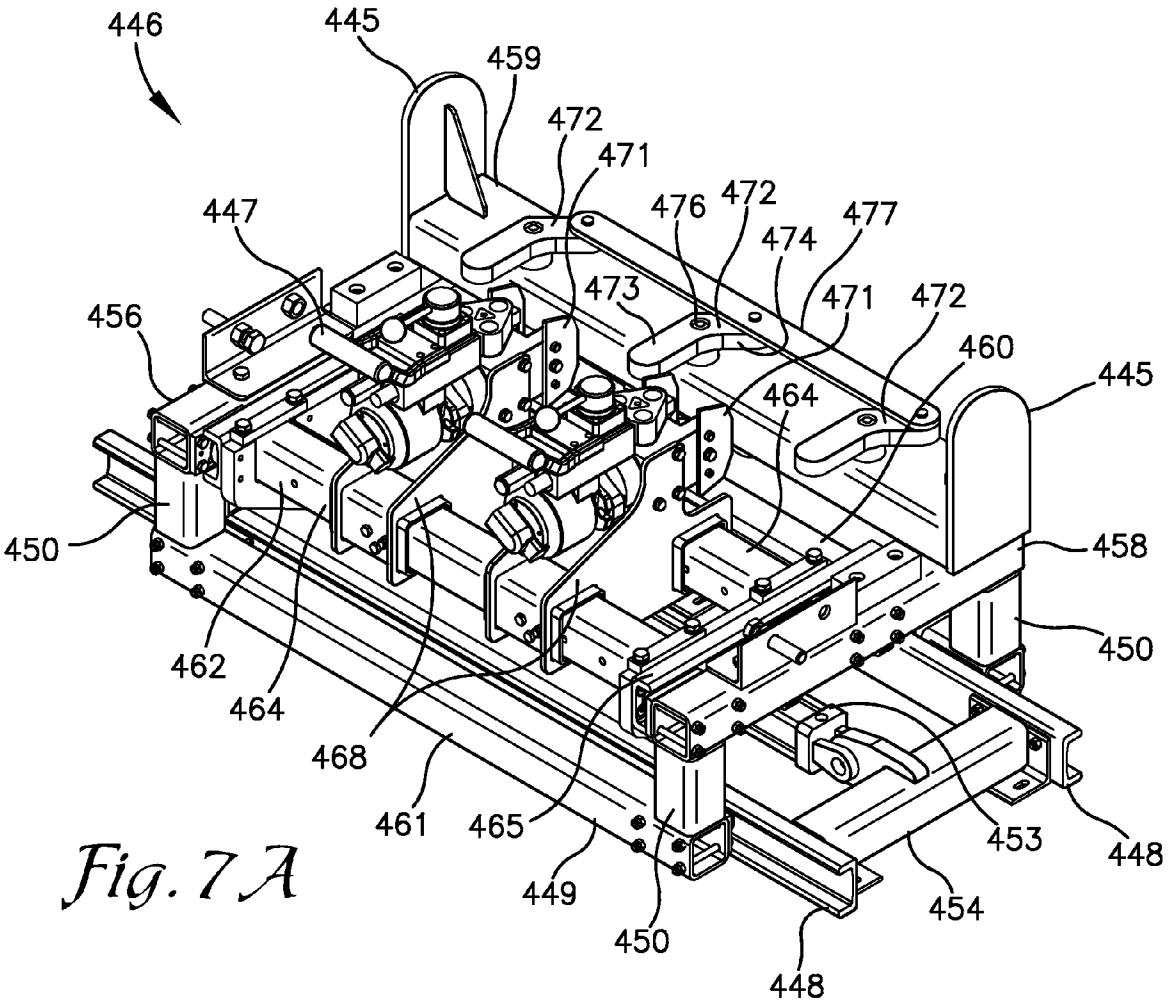
FIG. 7A is a top perspective view of a drill station depicted in accordance with an embodiment of the invention.
Figure 7C:
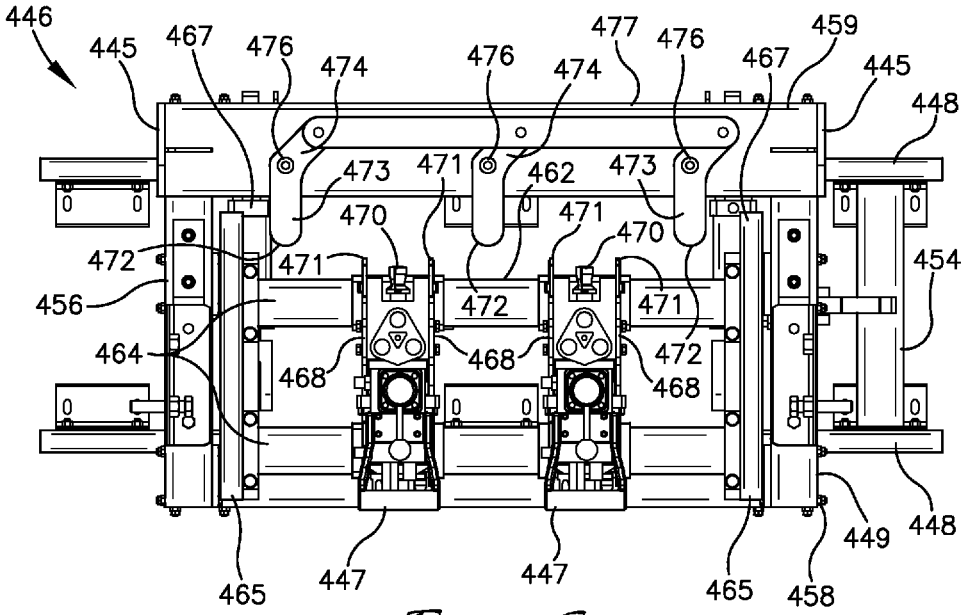
FIG. 7C is a top plan view of the drill station of FIG. 7A.
Figure 7B:
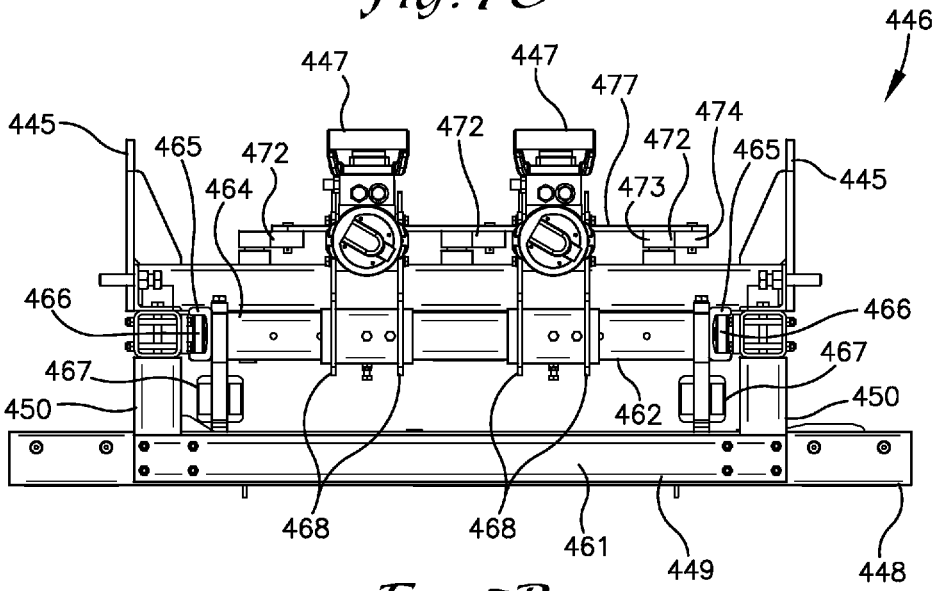
FIG. 7B is an inboard side elevational view of the drill station of FIG. 7A.
Figure 7D:
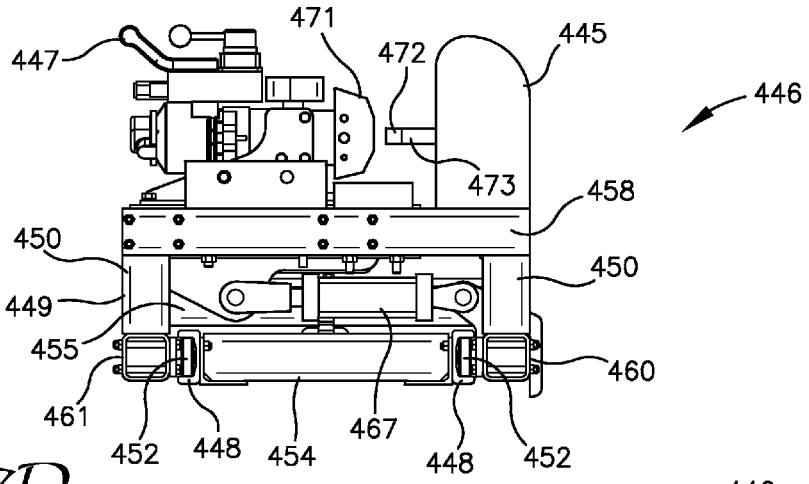
FIG. 7D is an end elevational view of the drill station of FIG. 7A.
Figure 7E:
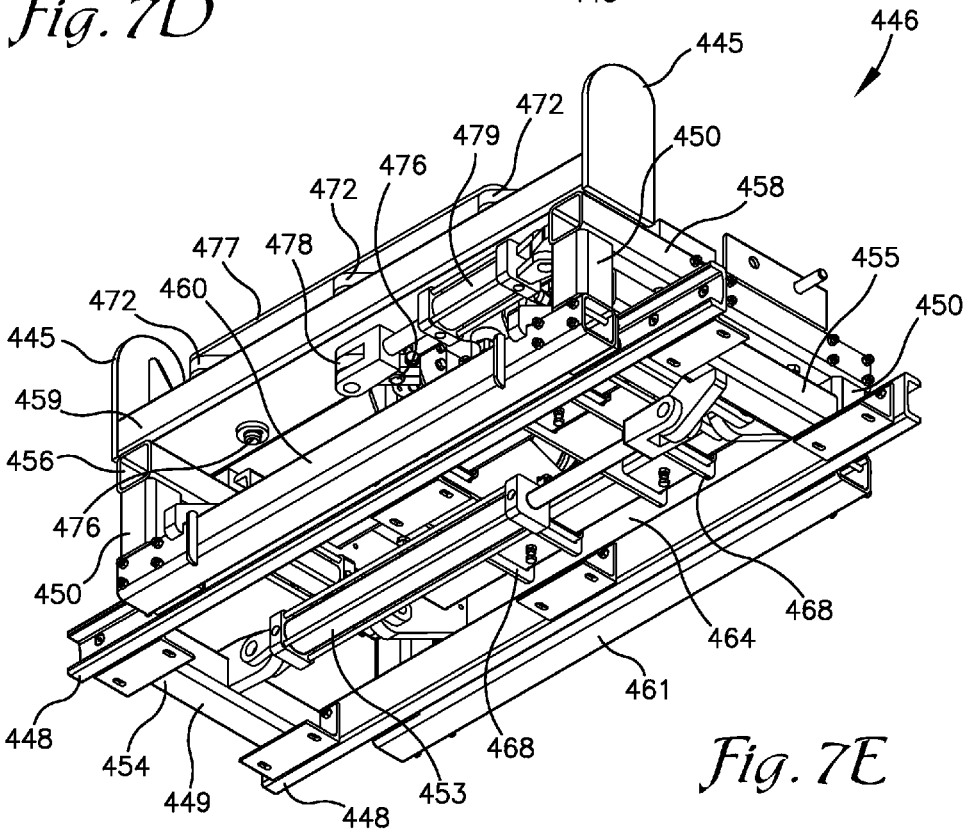
FIG. 7E is a bottom perspective view of the drill station of FIG. 7A.

At least one of the clamp stops 472 is fixedly rotationally coupled to its respective pin 476 and, the pin 476 includes an arm 478 extending radially outward therefrom that is also fixedly rotationally coupled thereto (see FIG. 7E). The arm 478 is disposed at an opposite end of the pin 476 from the clamp stop 472 and beneath the clamp support member 459. A clamping actuator 479 is coupled between a distal end of the arm 478 and the lower frame 449 and, when actuated, causes rotation of the attached pin 476 and thus the clamp stop 472 fixedly rotationally coupled thereto. The remaining clamp stops 472 are also rotated due to their interconnection via the connector bar 477.

Rotation of the clamp stops 472 moves the distal end of their first portions 473 toward the drill units 447 and against the web 48 of the ribbon rail 22 disposed therebetween. The ribbon rail 22 is thereby clamped between the clamp stops 472 and the abutments 471 attached to the upper frame 462 and/or drill units 447. The clamp stops 472 and the drill units 447 can be positioned offset longitudinally and/or vertically with respect to one another so as to avoid the drill bits 470 contacting and damaging the clamp stops 472 as they drill through the ribbon rail 22.

Figure 6G:
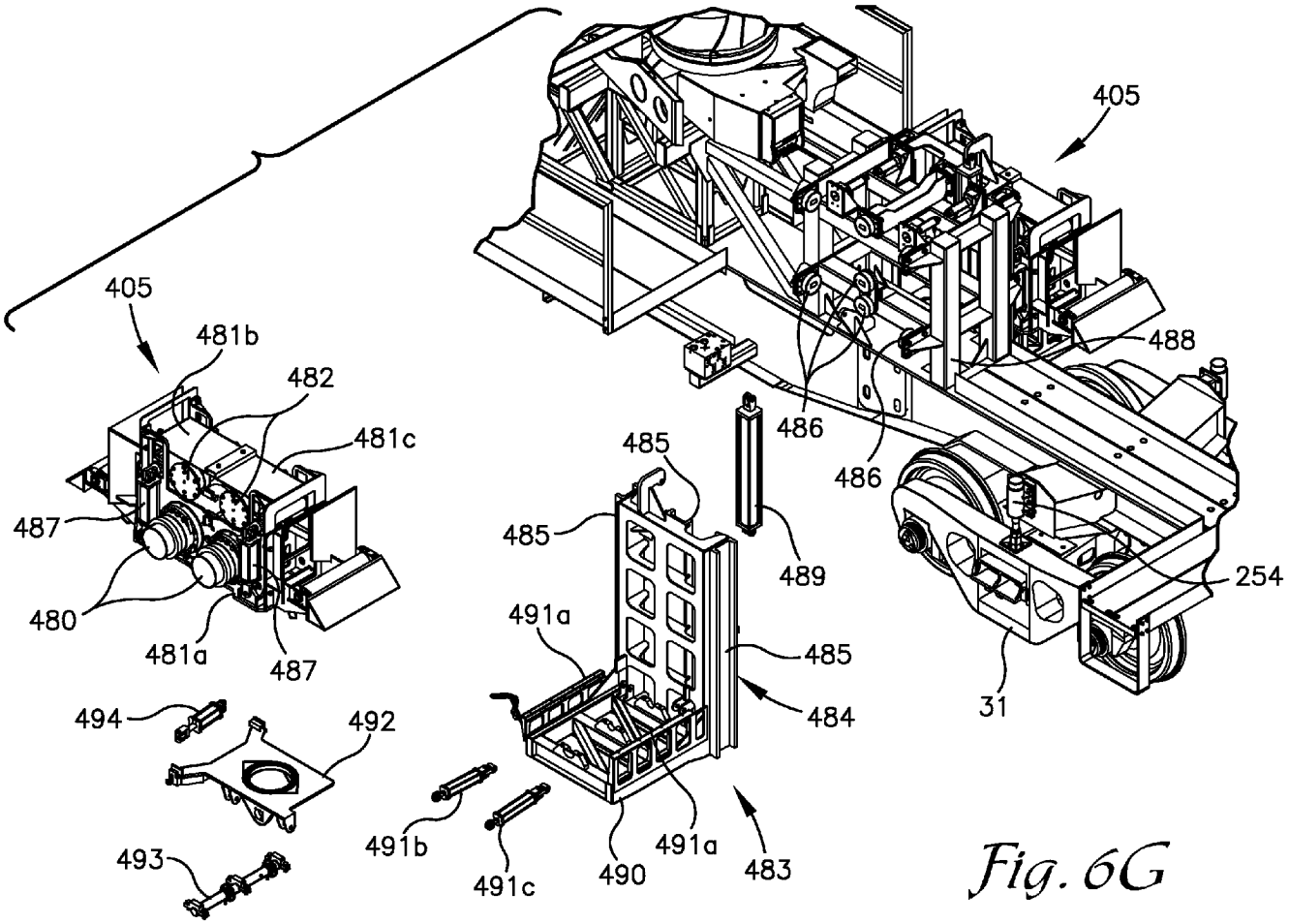
FIG. 6G is a partial exploded view of a mounting assembly for a secondary drive unit of the processing car of FIG. 6A.

With additional reference now to FIG. 6G, the secondary drive unit 405 is generally similar to the primary drive unit 302 and thus is not described in detail here. As depicted in FIGS. 6A-C and G, the secondary drive unit 405 includes two powered roller units 480 and two free or non-powered roller units 482 and thus may have less power than the primary drive unit 302 which has four powered roller units 334. As the secondary drive unit 405 is generally tasked with loading and unloading ribbon rails 22 from the rail transport train 12 and not pulling and dragging the ribbon rail 22 along the ground to the machine 10, the secondary drive unit 405 need not have the power capabilities of the primary drive unit 302, although it could.

The secondary drive unit 405, like the primary drive unit 302, includes a lower housing 481*a* and a pair of upper housings 481*b* and 481*c* that are pivotally coupled to the lower housing 481*a*. Actuators 487 are coupled between the lower housing 481*a* and the upper housings 481*b-c* and are operable to vertically pivot the upper housings 481*b-c* away from the lower housing 481*a* to enable ribbon rail 22 with debris thereon to pass through the secondary drive unit 405 in a manner similar to that discussed previously above with respect to the primary drive unit 302.

The secondary drive unit 405 is mounted to the body 28 of the processing car 400 adjacent the rear end of the processing car 400 and on an opposite side of the cutting and drilling stations 403, 404 from the primary drive unit 302. A drive mount assembly 483 that provides vertical, transverse, and rotational movement of the secondary drive unit 405 is provided. The drive mount assembly 483 includes a vertical track assembly 484 that includes a plurality of vertically extending tracks 485 that are slideably coupled to bearings 486 disposed on a support stand 488 coupled to the top and/or side of the body 28 of the processing car 400. A lifting actuator 489 is coupled between the body 28 and the drive mount assembly 483 to provide vertical lifting or adjustment of the secondary drive unit 405.

The drive mount assembly 483 includes a carriage 490 on which the drive unit 405 is mounted. The carriage 490 extends from the vertical track assembly 484 horizontally in a direction transverse and away from the body 28. The carriage 490 is configured to enable movement of the drive unit 405 horizontally toward and away from the body 28 along a pair of tracks 491*a* via actuation of a pair of actuators 491*b*, 491*c* coupled between a mounting plate 492 that is slideably disposed on the tracks 491*a* and the carriage 490. The drive unit 405 can thus be moved between a stowed position nearest the body 28 to an operational position furthest from the body 28 and to any point therebetween. The drive unit 405 can have up to about eighteen inches of travel or more preferably up to about six and one half inches of horizontal travel.

The mounting plate 492 is pivotally coupled to the carriage 490 about an elongate, cylindrical member 493 extending transverse to the body 28 to enable vertical tilting or pitching of the mounting plate 492 and the drive unit 405 coupled thereto about an axis extending coaxially with the member 493. The actuators 491*b-c* that provide the horizontal movement of the guide plate 492 and drive unit 405 are also actuatable to tilt the guide plate 492. The rearward actuator 491*c* is disposed between the mounting plate 492 and the carriage 490 at an upward angle. As such, the rearward actuator 491*c* can be selectively actuated with respect to the forwardly mounted actuator 491*b* to cause the mounting plate 492 to tilt or pitch about the member 493. The drive unit 405 can thus be tilted or pitched up to about ten degrees or more preferably up to about four degrees to enable directing of the ribbon rail 22 upward or downward.

The drive unit 405 is rotatably coupled to the mounting plate 492 to enable rotational movement of the drive unit 405 about a generally vertical axis. A twist actuator 494 is coupled between the mounting plate 492 and the drive unit 405. The twist actuator 494 is actuatable to rotate the drive unit 405 about its coupling with the mounting plate 492 up to about fifteen degrees or more preferably up to about six degrees to direct the ribbon rail 22 horizontally side-to-side.

Movements of the drive unit 405 are thus controllable using one or more of the actuators 489, 491*b-c*, and 494. These actuators 489, 491*b-c*, and 494 can maintain a desired position of the drive unit 405 against forces applied on the drive unit 405 by bending or binding of the ribbon rail 22. Or a float setting of the hydraulic system associated with the actuators 489, 491*b-c*, and 494 can be employed to relax the actuators 489, 491*b-c*, and 494 and allow the drive unit 405 to move to an equilibrium position with the forces applied thereon by the ribbon rail 22 to thereby relieve at least a portion of tension or binding forces applied on the rail 22.

With continued reference to FIGS. 6A-C, the processing car 400 also includes an elevated operator's station 495 and a secondary rail lifting and manipulating apparatus or crane 498*a* mounted on the body 28. The operator's station 495 is located toward the front end of the car 400 generally forward of the cutting station 403. The operator's station 495 is preferably positioned to provide an operator in the station 495 with an unobstructed line of sight to the cutting station 403 for viewing of the ribbon rail 22 for alignment and cutting by the cutting station 403. Alternatively, one or more cameras (not shown) and associated monitors can be provided in the operator's station 495 to provide the operator with views of the ribbon rail 22 in association with one or more of the components 402, 403, 404, 405.

Control stations are provided in the operator's station 495 for operation of one or more of the guide box 402, cutting station 403, drill units 404, and secondary drive unit 404. Control stations might also be provided that enable operation of components disposed on one or more of the cab car 100, pick-up car 200, and crossover car 300, such as the primary drive unit 302 or crossover guide assembly 306. The control stations are also provided in pairs with one member of each pair being positioned on a side of the operator's station corresponding to the associated components 402, 403, 404, 405 disposed along that side of the car 400. Providing the control stations dedicated to operation of components 402, 403, 404, 405 on a single side of the processing car 400 enables simultaneous processing of ribbon rails 22 on both sides of the processing car 400, e.g. a first ribbon rail 22 can be loaded along a left side of the processing car 400 while, at the same time, a second ribbon rail 22 is offloaded from the right side. Alternatively, a single control station might be provided that is selectively operable for controlling components disposed along both sides of the processing car 400.

An elevated walkway 496 is provided for operator access to the operator's station 495. A plurality of additional walkways 441 is disposed on a main level of the processing car 400 generally level with the top surface of the body 28 for access to the elevated walkway 496 and the components 402, 403, 404, 405. One or more secondary control stations (not shown) for operation of one or more of the components 402, 403, 404, 405 might also be mounted on the walkways 496 or 441.

The crane 498*a* is disposed near the rear end of the processing car 400 and is mounted on a stand 498*b* coupled to the body 28. The crane 498*a* can comprise any hydraulic or electric actuated, remotely operated crane, excavator, robotic arm, or the like available in the art. For example, as depicted in FIGS. 6A-C, the crane 498*a* comprises a model PK40002-EH crane from Palfinger USA, Inc. of Tiffin, Ohio. The crane 498*a* is disposed between the drill station 404 and the secondary drive units 405, however, other placements are possible. The crane 498*a* includes an articulated arm 498*c* with an end-arm attachment 498*d* coupled to an end thereof that is useable to manipulate the ribbon rail 22 on the processing car 400 and/or to aid loading/unloading of a rail transport train 12 coupled to the rear end of the processing car 400. The arm 498*c* of the crane 498*a* has sufficient length or reach to load/unload the rail 22 from the stands 16 of the rail transport train 12. A base 498*e* of the crane 498*a* enables rotation of the crane 498*a* about a vertical axis and may provide forward and aft and/or side-to-side movements of the crane with respect to the processing car 400. Outriggers and/or stabilizers, like the stabilizing jacks 254, might also be provided.

Operation

The operation of the rail loading and unloading machine 10 will now be described in accordance with an embodiment of the invention. For loading of a ribbon rail 22 onto a rail transport train 12 by the machine 10, the ribbon rail 22 is first detached from the track bed and/or ties. Where parallel or side-by-side sets of tracks are available the machine 10 can be driven along the parallel set of tracks to a location adjacent or near the detached ribbon rail 22. Where only a single set of tracks is available, new or replacement track, e.g. ribbon rail 22, is installed prior to picking up the detached ribbon rail 22 with the machine 10. In such an instance, the machine 10 might first be employed to lay the new or replacement track or ribbon rail 22 alongside the track that is to be replaced before it is detached from the track bed. In either scenario, the machine 10 and a rail transport train 12 are driven along a set of existing tracks using a locomotive coupled to the machine 10 or to the rail transport train 12 to a location near an end of the ribbon rail 22 to be loaded onto the rail transport train 12. The end of the ribbon rail 22 is positioned generally alongside the pick-up car 200 with the length of the ribbon rail 22 extending forward of the machine 10.

The stabilizing jacks 254 can be actuated to stabilized the pick-up car 200 prior to or during operation of the rail lifting and manipulating apparatus 204. Stabilizing jacks 254 might also be actuated on one or more of the crossover car 300 and processing car 400 to provide stabilization thereof. The stabilizing jacks 254 are actuated to extend the pistons 256 vertically downward and to place the feet 258 into contact with the frame 40 of the truck 30 located below the respective stabilizing jack 254. The stabilizing jacks 254 can be extended to fully eliminate the suspension system 44 of the trucks 30 or might be extended to only partially restrict movements of the suspension 44. The stabilizing jacks 254 might also be selectively extended to provide leveling of the pick-up car 200, crossover car 300, and/or processing car 400.

The guide box 260 on the same side of the pick-up car 200 as the ribbon rail 22 is pivoted outwardly from the stowed position to the operational position by the actuator 264, as depicted in phantom lines in FIG. 3C. The jaws 276 of the guide box 260 are pivoted away from one another to the open position by actuating the actuators 278. The rail lifting and manipulating apparatus 204 grasps the rail 22 using the jaws 252 of the end arm tool 250 and orients the rail 22 in an upright position with the head 46 of the rail 22 vertically above the web 48 and foot 50. The ribbon rail 22 is laid or inserted between the jaws 276 of the guide box 260 and the actuators 278 actuated to pivot the jaws 276 to the vertical position with the rail captured therebetween. As such, the foot 50 of the rail 22 is located on the base rollers 270 and the head 46 is disposed between the first segments 292 and against or adjacent the second segments 294 of the rollers 284.

The rail lifting and manipulating apparatus 204 feeds the end of the ribbon rail 22 into the primary drive unit 302 located along the same side of the machine 10 as the guide box 260 and the ribbon rail 22. Alternatively, the rail lifting and manipulating apparatus 204 can feed the end of the ribbon rail 22 into the primary drive unit 302 first and then place the rail 22 into the guide box 260.

The rail lifting and manipulating apparatus 204 may be used to pull the ribbon rail 22 toward the guide box 260 and/or the primary drive unit 302 in order to engage the rail 22 in those components. The machine 10 might also be moved along the tracks to aid in such manipulations. The drive motors 242 on the platform 224 can be used to move the rail lifting and manipulating apparatus 204 along the transit rail 202 to pull the ribbon rail 22. The cogwheels 244 of the drive motors 242 and the chain 216 attached to the web 214 of the transit rail 202 provide a strong positive engagement that enables the rail lifting and manipulating apparatus 204 to pull the ribbon rail 22 with greater than 80,000 pounds of pulling force, e.g. the drive motors 242 can drive the rail lifting and manipulating apparatus 204 along the transit rail 202 while the rail lifting and manipulating apparatus 204 grasps the ribbon rail 22. The actuation of the rail lifting and manipulating apparatus 204 about one or more of its axes might also provide additional pulling power.

The ribbon rail 22 is received in the drive channel 338 of the primary drive unit 302 and between the drive roller units 334. The motors 342 are activated to drive the drive roller units 334 and draw the ribbon rail 22 through the primary drive unit 302. The drive unit 302 is configured to provide greater than 120,000 pounds of pulling force on the ribbon rail 22 but, if needed the rail lifting and manipulating apparatus 204 can provide additional pulling force as described above.

The position of the primary drive unit 302 can be manipulated to move the unit 302 inboard or outboard using the positioning actuators 322, tilted vertically using the tilt actuator 324, or rotated about a vertical axis using the twist actuator 331 to steer the ribbon rail 22 over the support roller assembly 304 and toward a desired side of the cross-over car 300. Upon engagement of the ribbon rail 22 with a desired downstream component as described below, the hydraulic systems used to operate the actuators 322, 324, and 331 can be relaxed using a float setting. The float setting enables the drive unit 302 to move freely based on forces applied thereon by, for example, bending and tension forces applied to the rail 22. As such, the drive unit 302 can be allowed to move to reduce such forces and forces applied to upstream and downstream components. The guide box 260 can also utilize a float setting in a similar manner.

The ribbon rail 22 passes over the support roller assembly 304 and to the crossover guide assembly 306. The ribbon rail 22 can be directed to an opposite side of the crossover car 300 by the crossover guide assembly 366 or can continue along the same side to the processing car 400. The ribbon rail 22 is positioned on the guide carrier 354 of the crossover guide assembly 304 to the side of the vertical stand 362 corresponding with the side of the crossover car 300 to which the rail 22 is to be directed, e.g. the rail 22 is positioned on the right side of the vertical stand 362 to direct the rail 22 to the right side of the crossover car 300 and vice versa. The rail 22 is also positioned between the guide rollers 368 and rollers disposed in the base 360 thereof. The threaded rod 358 coupled to the guide carrier 354 is rotated to move the guide carrier 354 left or right across the crossover guide assembly 304 and thereby push the rail 22 left or right toward the desired side of the crossover car 300 and toward the desired path 406 along the processing car 400.

The ribbon rail 22 is next received by the guide box 402 mounted on the processing car 400. As described previously, the guide box 402 is similarly configured to the guide box 260 on the pick-up car 200. The rail 22 is thus similarly received by the guide box 402, e.g. jaws of the guide box 402 are pivoted outwardly to the open position, the rail 22 is inserted therebetween, and the jaws are pivoted to the vertical position with the rail 22 therebetween. The guide box 402 might also be moved up, down, left, or right to ease insertion of the rail 22 therein using the carriage 408 and associated components.

After receipt of the ribbon rail 22 by the guide box 402, the guide box 402 can be moved up, down, left, or right to position the rail 22 on the bypass route 418 or the cutting route 419, the cutting route 419 being chosen when the rail 22 is to be cut and/or drilled for coupling to another section of rail 22. When the bypass route 418 is chosen, the rail 22 is driven by the primary drive unit 302 past the cutting station 403 and the drill station 404 to the secondary drive unit 405. The rail 22 may be supported between the guide box 402 and the secondary drive unit 405 by the support members 426 on the cutting station 403 and/or by one or more rollers 499 extending vertically upward from the walkway 441 near the drill station 404.

The secondary drive unit 405, like the primary drive unit 302 receives the rail 22 in a drive channel thereof. The secondary drive unit 405 is moved vertically along its associated track assembly 484, horizontally via the carriage 490, pitched and/or rotated about a vertical axis to direct the rail 22 toward a desired location on the trailing rail transport train 12. The crane 498*a* can also be employed to grasp the rail 22 subsequent to the secondary drive unit 405 and to direct the rail 22 into a pocket on the stands 16 of the rail transport train 12. The secondary drive unit 405 and the guide box 402 can also utilize a float setting to allow them to move freely and reduce forces applied to the rail 22 as discussed previously above with respect to the primary drive unit 302 and the guide box 260.

When the rail 22 is engaged in both the primary and secondary drive units 302, 405 one of the units 302, 405 can be powered down or placed in a neutral or freewheeling operational mode such that only one of the units 302, 405 drives the rail 22. Or both units 302, 405 can simultaneously drive the rail 22. The drive units 302, 405 can be operatively coupled for simultaneous operation such that both units 302, 405 drive the rail 22 at the same speed to avoid buckling or binding of the rail 22 therebetween. One or both of the drive units 302, 405 can also be provided with a clutch or similar system to accommodate for the units 302, 405 driving the rail 22 at different speeds.

When the rail 22 is to be cut the cutting route 419 is chosen. Initially, the rail 22 is passed from the guide box 402 to the secondary drive unit 405 as described above and is driven along the cutting route 419. The available movements of the guide box 402 and the secondary drive unit 405 might also be employed to move the ribbon rail 22 from the bypass route 418 to the cutting route 419 or vice versa after being passed along the length of the processing car 400.

An operator located in the elevated operator's station 495 or at an auxiliary operator's station (not shown) mounted along the walkway 441 or 496 can control the primary and/or secondary drive units 302, 405 to position the rail 22 in the cutting station 403 such that a cutting location along the rail 22 is lined up with the blade 425 of the saw 420. The actuators 430 are actuated to pivot the clamping assembly 429 from the lowered position to the raised, clamping position. The three rams 424 are extended to contact and hold the rail 22 on the support members 426 and, the clamps 435 are pivoted to hold the rail 22 downwardly against the support members 426. The saw 420, with the blade 425 rotating, is pivoted toward the rail 22 until reaching the end of its stroke with the blade 425 cutting through the rail 22 and then retracts to its original position. The rams 424 and the clamps 435 are retracted or released and the clamping assembly 429 pivoted to the lowered position. The movements of the saw 420, rams 424, and clamping assembly 429 can be configured for manual or automatic operation.

After cutting of the rail 22 a forward section of the rail 22 is driven by the primary drive unit 302 while a rearward section of the rail 22 is driven by the secondary drive unit 405. The rearward section of the rail 22 is thus driven by the secondary drive unit 405 onto the rail transport train 12. The forward section of the rail 22 is driven by the primary drive unit 302 toward the secondary drive unit 302 to again engage the forward section of the rail 22 with the secondary drive unit 405 to continue loading the rail 22 on the rail transport train 12.

The rail 22 might be cut during a loading operation such as this when a pocket of the rail transport train 12 is full. Thus, the rail 22 is cut and the forward section thereof is placed in a different pocket. Alternatively, in an unloading operation, after cutting the rail 22, the forward section is driven by the primary drive unit 302 forward and off of the machine 10 adjacent to the tracks on which the machine 10 is traveling. The rearward section can then be driven forward by the secondary drive unit 405 toward the primary drive unit 302 for continued unloading or returned to the rail transport train 12.

During loading and/or unloading of the ribbon rail 22 there is often a need to join a forward section of rail 22 end-to-end with a rearward section of rail 22. For example, it is desirable to completely fill pockets on the rail transport train 12, but the lengths of ribbon rail 22 that are picked up may not coincide with the lengths of the pockets. Thus, during loading of the ribbon rail 22 two sections of rail 22 can be coupled together to fill the respective pocket.

To join a forward section of rail 22 with a rearward section, the forward section is driven by the primary drive unit 302 while the rearward section is driven by the secondary drive unit 405 to bring their ends together at the drill station 404. Both drive units 302, 405 can be controlled by an operator in the operator's station 495.

The drill station 404 is raised from beneath the walkway 441 by actuating the lift table 442. As the lift table 442 raises, the ears 445 contact the cover panels 444 and act as cams to pivot the cover panels 444 open. The drill units 447 are aligned vertically with the web 48 of the forward and rearward sections of rail 22. The drill units 447 are also aligned along the length of the forward and rearward sections of the rail 22 such that at least one drill unit 447 is aligned to drill each of the sections, e.g. at least one hole will be drilled in the forward section and one hole will be drilled in the rearward section. The primary and secondary drive units 302, 405 can be employed to adjust the positions of the forward and rearward sections of the rail 22 independently or the drill carriage 446 can be moved along the length of the rails 22 using the tracks 448 and their associated bearings 452 and positioning actuator 453.

The clamping actuator 479 is actuated to rotate the first portions 473 of the clamp stops 472 into contact with the webs 48 of the forward and rearward sections of rail 22. The drill carriage 446 is moved toward the sections of rail 22 from the side opposite the clamp stops 472 by actuating the actuator 467 to place the abutments 471 into contact with the rails 22. Thereby, sections of rail 22 are clamped in position between the abutments 471 and the clamp stops 472. An operator standing on the walkway 441 or positioned in the operator's station 495 can then activate the drill units 447 to drill the sections of rail 22. The drill bits 470 of the drill units 447 extend outwardly from the drill units 447 to drill through the rail 22 and then retract. The drilled rails 22 can be released from the clamp stops 472 and the abutments 471 and the drill station 404 retracted beneath the walkway 441. The operator is thus provided with ample workspace to install joint bars plates 52 on each side of the webs 48 of the rail sections 22, e.g. operator can stand on top of the cover panels 444 and the drill station 404 does not obstruct his or her activities.

The joint bars 52 comprise elongate flat bar stock with mounting holes therein. The mounting holes are spaced to correspond with the spacing of the drill units 447 such that mounting holes in the joint bars 52 align with the holes drilled in the sections of rail 22. The operator can thus easily install bolts 54 or other fasteners through the mounting holes and the drilled holes in the rails 22 without the need to realign the sections of rail 22 and without the risk of the holes being misaligned; misalignment of the holes might result in the joint bars 52 not fitting because the drilled holes in the rails 22 are too far apart, or a gap between the ends of the rail sections 22 because the drilled holes are too close together. The joined sections of rail 22 can then be loaded onto the rail transport train 12 or unloaded as desired.

Figure 9:
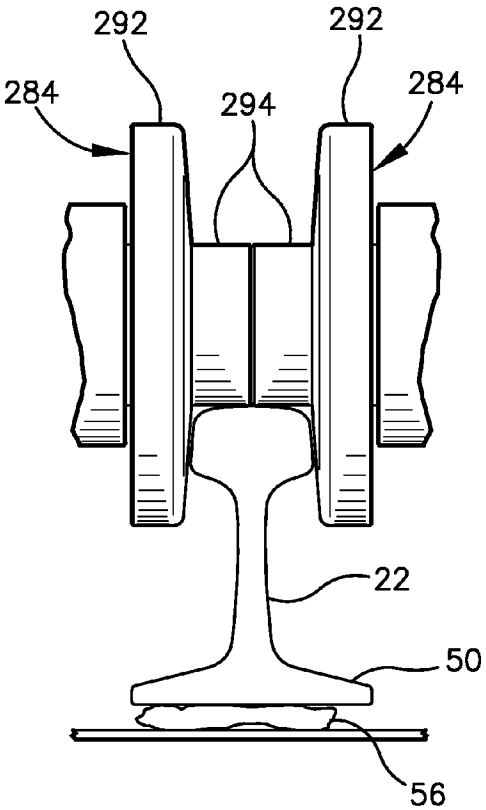
FIG. 9 is a diagrammatic cross-sectional view of a ribbon rail depicting upset weld debris attached to a lower surface of a bottom flange or foot thereof and passing through a guide box in accordance with an embodiment of the invention.
Figure 8:
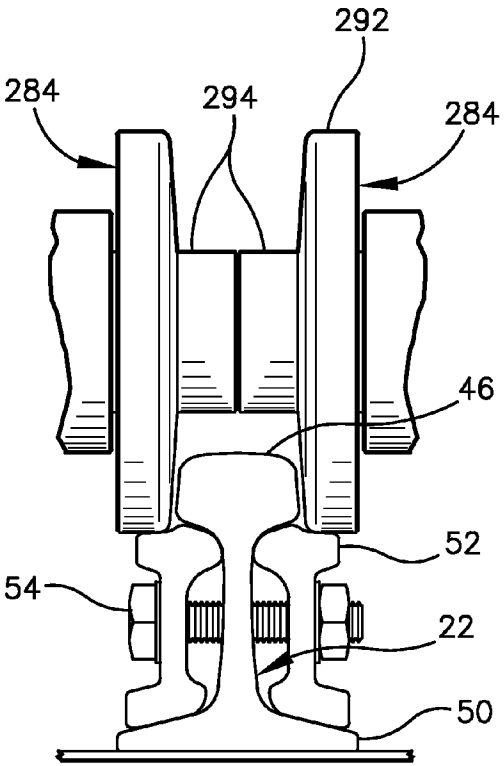
FIG. 8 is a diagrammatic cross-sectional view of a ribbon rail depicting joint bars coupled to the web thereof and passing through a guide box in accordance with an embodiment of the invention.

As depicted in FIG. 8, the joint bars 52 and/or bolts 54 used to join the sections of rail 22 can extend sufficiently outward from the web 48 to obstruct passage of the rail 22 through the guide boxes 260, 402. Debris 56, such as material from an upset weld, attached to the ribbon rail 22 might also form such obstructions, as depicted in FIG. 9. However, the guide boxes 260, 402 and the drive units 302, 405 are configured to enable passage of such obstructions. As described previously, upon encountering an obstruction by one of the guide boxes 260, 402, the hydraulic actuator 290 coupled between the roller housing 286 and the distal end of the jaw 276 of the guide box 260, 402 allows the roller assembly 280 to pivot about the coupling with the ears 280 to raise the roller 284 away from the ribbon rail 22 and allow the obstruction to pass without disengaging the ribbon rail 22 from the guide box 260, 402. Similarly, the actuators 339, 487 coupled to the upper housings 335*a-b*, 481*b-c* of the primary and secondary drive units 302, 405, respectively, can be actuated to raise the upper housings 335*a-b*, 481*b-c* to allow passage of the obstructions. If necessary, the forward 335*a*, 481*b* upper housings can be raised independent of the rearward upper housings 335*b*, 481*c* to enable the drive roller units disposed in at least one of the housings 335*a-b*, 481*b-c* to remain in driving contact with the rail 22 at all times. Additionally, when the rail 22 is engaged in both the primary and secondary drive units 302, 405 both of the upper housings 335*a-b*, 481*b-c* of one of the drive units 302, 405 can be raised while the drive roller units of the other drive unit 304, 405 remains in driving contact with the rail 22.

In an unloading operation, the rail lifting and manipulating apparatus 498*a* is employed to extract a ribbon rail 22 from the stands 16 of the rail transport train 22 and to insert the end thereof into the secondary drive unit 405. The secondary drive unit 405 can then drive the rail 22 forward along the path 406 to the guide box 402 and on to the crossover car 300. As done in loading, the crossover guide assembly 306 can be used to steer the rail 22 toward a desired side, e.g. left or right, of the crossover car 300 and toward either the left or right primary drive unit 302. The rail lifting and manipulating apparatus 204 on the pick-up car 200 can be used to aid insertion of the rail 22 into the primary drive unit 302 or workers can manually steer the rail 22, such as by hand or using crowbars or the like. Alternatively, the rail lifting and manipulating apparatus 204 and/or the guide box 402 on the processing car 400 can steer the rail 22 from the processing car 400 directly toward the ground adjacent to the machine 10 without passing the rail 22 over the crossover car 300 or through the primary drive unit 302.

After passing through the primary drive unit 302, the rail 22 is inserted into the guide box 260 on the pick-up car 200 by the rail lifting and manipulating apparatus 204. The rail 22 is then guided toward the ground adjacent to the machine 10 by the guide box 260 and/or by the rail lifting and manipulating apparatus 204. The rail lifting and manipulating apparatus 204 might alternatively direct the rail 22 directly toward the ground from the primary drive unit 302 without using the guide box 260. The primary drive unit 302 might also be moved horizontally, vertically, pitched, or rotated about a vertical axis as described previously to direct the rail 22 toward the ground alongside the machine 10.

The primary and/or secondary drive units 302, 405 can drive the rail 22 off of the machine 10 along the ground forward of the machine 10. The machine 10 might also be moved rearward while the rail 22 is driven off to aid the unloading thereof.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and sub-combinations are of utility and may be employed without reference to other features and sub-combinations and are contemplated within the scope of the claims.

What is claimed is:

1. A guide box assembly for manipulating a rail on a rail loading and unloading machine, the guide box assembly comprising:

a base roller on which a foot of a rail travels, the base roller having a rotational axis extending perpendicular to the length of the rail and being disposed on a base member;

a pair of sidewalls disposed transverse to opposite ends of the base roller;

a first roller assembly pivotably coupled to the sidewalls and extending from the sidewalls in a first direction parallel to the rail and including a first upper roller rotatably coupled to the first roller assembly, the first upper roller being pivotable about a first axis extending parallel to the rotational axis of the base roller to move the first upper roller toward or away from the base member; and a second roller assembly pivotably coupled to the sidewalls and extending in a direction opposite the first direction and including a second upper roller rotatably coupled to the second roller assembly, the second upper roller being spaced apart from the first upper roller along the length of the rail, the second roller assembly being pivotable about a second axis extending parallel to the rotational axis of the base roller to move the second upper roller toward or away from the base member, the first roller assembly and the second roller assembly being independently pivotable.

2. The guide box assembly of claim 1, wherein the pair of sidewalls are pivotable about respective sidewall axes extending perpendicular to the rotational axis of the base roller, and wherein the first upper roller comprises a pair of upper roller portions that are each rotatably coupled to a respective sidewall of the pair of sidewalls and that are separable to enable the pair of sidewalls to pivot away from one another about the respective sidewall axes.

3. The guide box assembly of claim 2, wherein the first roller assembly includes a pair of pivot arms, each of the pivot arms coupled to a respective one of the pair of sidewalls and an actuator coupled between each pivot arm and the respective sidewall, the actuators being operable to pivot the respective pivot arms about the first axis to move the first upper roller portions toward or away from the base member.

4. The guide box assembly of claim 3, wherein the sidewalls are pivoted away from one another to enable a rail to be placed on the base roller and are pivoted toward one another to capture the rail between the upper roller portions and the base roller, and wherein the first upper roller pivots away from the base member on the pivot arm to allow obstructions on the rail to pass between the first upper roller and the base roller.

5. The guide box assembly of claim 1, wherein the first upper roller comprises a guide roller that includes a central portion having a first diameter disposed between a pair of annular flanges having a second diameter that is greater than the first diameter, the central portion having dimensions sufficient to receive a head of the rail therein and between the pair of annular flanges.

6. The guide box assembly of claim 1, wherein the independent pivoting of the first and the second roller assemblies maintains constant contact with the rail by at least one of the first upper roller and the second upper roller.

7. A guide box assembly for a rail loading and unloading machine, the guide box assembly comprising:

a base roller on which a foot of a rail travels, the base roller having a rotational axis extending perpendicular to the length of the rail;

a pair of jaws, each jaw of the pair disposed adjacent an opposite end of said base roller and pivotable about a respective jaw axis extending perpendicular to the rotational axis of said base roller;

a forward roller assembly and a rearward roller assembly mounted on at least one of the jaws, said forward and rearward roller assemblies extending from the jaws in opposite directions parallel to the length of the rail and each including a pivot arm pivotable relative to the respective jaw, and a guide roller rotatably mounted on said pivot arm and extending from said pivot arm over a path of the rail through the guide box, each said pivot arm pivotable about a respective arm axis extending parallel to the rotational axis of the base roller to move said respective guide roller toward or away from said base roller, the pivot arms of the forward and rearward roller assemblies being independently pivotable and maintaining constant contact with the rail by at least one of the guide roller of the forward roller assembly and the guide roller of the rearward roller assembly.

8. The guide box assembly of claim 7, wherein said jaws are pivoted away from one another to enable a rail to be placed on said base roller and are pivoted toward one another to capture the rail between said guide roller and said base roller, and wherein said guide roller pivots away from said base roller on said pivot arm to allow obstructions on the rail to pass between said guide roller and said base roller.

9. The guide box assembly of claim 7, wherein there are two of said roller assemblies, each of said roller assemblies mounted on a respective one of said jaws such that distal ends of the respective guide rollers are in close proximity when said jaws are pivoted toward one another.

10. The guide box assembly of claim 9, wherein said distal ends of said guide rollers abut when said jaws are pivoted toward one another.

11. The guide box assembly of claim 9, wherein each said guide roller includes a proximate section with a first diameter and a distal section located at said distal end of the respective guide roller and having a second diameter that is less than said first diameter.

12. The guide box assembly of claim 11, wherein said distal sections of said guide rollers overlie a head of the rail to enclose the rail between said guide rollers and said base roller, and said proximate sections extend alongside opposite sides of the head to capture the rail therebetween.

13. The guide box assembly of claim 7, further comprising:

a baseplate on which said base roller and said jaws are mounted;

a pair of first actuators, each first actuator coupled to said baseplate and a respective one of said jaws and operable to pivot the respective jaw about the respective jaw axis;

a second actuator mounted between the roller assembly and the one of said jaws on which said roller assembly is mounted, said second actuator being operable to pivot said roller assembly toward or away from said base roller.

14. The guide box assembly of claim 13, wherein said second actuator functions as a shock absorber that enables said roller assembly to pivot away from said base roller to allow obstructions on the rail to pass between said guide roller and said base roller.

15. The guide box assembly of claim 7, in combination with a mounting arm, wherein:

said mounting arm is connected to said guide box assembly and pivotably coupled to a body of a rail car; and an arm actuator is coupled between said mounting arm and the body and operable to pivot said mounting arm from a retracted position in which said guide box assembly is adjacent to the body and an operational position in which said guide box assembly is extended away from the body.

16. The combination of claim 15, further comprising:

a mount disposed between a distal end of said mounting arm and the guide box assembly, said mount enabling one or more of rotation and tilting of said guide box assembly.

17. The guide box assembly of claim 7, wherein said guide box assembly is mounted on a carriage that is moveable one or more of vertically, horizontally, and rotationally.

18. A guide box assembly for a rail loading and unloading apparatus, the guide box comprising:

a first base roller and a second base roller on which a foot of a rail travels, the first and second base rollers disposed parallel and spaced apart along a path of the rail through the guide box assembly, the first and second base rollers having rotational axes extending perpendicular to the length of the rail and being disposed on a base member;

a pair of vertical support members disposed between the first and second base rollers along the path of the rail and on opposite sides of the path;

a first roller assembly and a second roller assembly pivotably coupled to each of the support members and disposed on opposite sides of the respective support member extending in opposite directions along the path of the rail, the first and second roller assemblies each including an upper roller rotatably coupled to the respective roller assembly, the upper roller being generally vertically aligned with the respective first or second base roller and each roller assembly being pivotable about a support-member axis extending between the support members to move the upper rollers toward or away from the respective first or second base rollers; and a first actuator coupled between the base member and the first roller assembly and a second actuator coupled between the base member and the second roller assembly, the first and second actuators operable to pivot the respective first and second roller assemblies about the support-member axis.

19. The guide box assembly of claim 18, wherein the first roller assembly and the second roller assembly are selectively pivotable via the first and second actuators to move one or both of the first and second upper rollers away from the respective first or second base rollers to allow passage of a debris on the rail through the roller assembly.

20. The guide box assembly of claim 18, wherein the first upper roller and the first base roller comprise a first roller pair and the second upper roller and the second base roller comprise a second roller pair, wherein one or both of the first upper roller and the first base roller are powered rollers and one or both of the second upper roller and the second base roller are powered rollers, and wherein the first and second roller assemblies are selectively pivoted to allow a debris on the rail to pass through the guide box assembly while maintaining driving contact between at least one of the first or second roller pairs and the rail at all times.

* * * * *